US007918458B2

(12) United States Patent
Fukazawa et al.

(10) Patent No.: US 7,918,458 B2
(45) Date of Patent: Apr. 5, 2011

(54) ARTICLE CAPTURING GAME MACHINE

(75) Inventors: Mitsuharu Fukazawa, Tokyo (JP); Hideki Watanabe, Tokyo (JP); Nobuto Kashiwagi, Tokyo (JP)

(73) Assignee: Kabushiki Kaisha Sega, Tokyo (JP)

( * ) Notice: Subject to any disclaimer, the term of this patent is extended or adjusted under 35 U.S.C. 154(b) by 98 days.

(21) Appl. No.: 12/527,095

(22) PCT Filed: Feb. 13, 2008

(86) PCT No.: PCT/JP2008/052295

§ 371 (c)(1),
(2), (4) Date: Aug. 13, 2009

(87) PCT Pub. No.: WO2008/099826

PCT Pub. Date: Aug. 21, 2008

(65) Prior Publication Data

US 2010/0090408 A1 Apr. 15, 2010

(30) Foreign Application Priority Data

Feb. 14, 2007 (JP) ..... 2007-034051

(51) Int. Cl.
*A63F 9/00* (2006.01)
*A63F 9/34* (2006.01)

(52) U.S. Cl. ..... 273/448

(58) Field of Classification Search ..... 273/447, 273/448

See application file for complete search history.

(56) References Cited

U.S. PATENT DOCUMENTS

2005/0218602 A1* 10/2005 Watanabe et al. ..... 273/447
2006/0170164 A1* 8/2006 Watanabe ..... 273/447
2007/0013139 A1* 1/2007 Kumagai ..... 273/448
2007/0029734 A1* 2/2007 Fukazawa et al. ..... 273/447
2008/0001360 A1* 1/2008 Fukazawa ..... 273/448
2009/0267302 A1* 10/2009 Fukazawa et al. ..... 273/447
2009/0278318 A1* 11/2009 Takasugi ..... 273/448
2009/0295095 A1* 12/2009 Watanabe et al. ..... 273/448
2010/0090408 A1* 4/2010 Fukazawa et al. ..... 273/447

FOREIGN PATENT DOCUMENTS

JP 11-156040 A 6/1999
JP 11-319308 A 11/1999
JP 2003-126542 A 5/2003
JP 2003-175273 A 6/2003
JP 2004-255172 A 9/2004
JP 2006-068218 A 3/2006
JP 2006-068833 A 3/2006
JP 2006-192029 A 7/2006
JP 2007-029322 A 2/2007
JP 2008125941 A * 6/2008
JP 2008194315 A * 8/2008

* cited by examiner

*Primary Examiner* — Raleigh W. Chiu
(74) *Attorney, Agent, or Firm* — Drinker Biddle & Reath LLP

(57) ABSTRACT

To enabling actions that meet even diversified display patterns such as a prize hooked on a prize drop hole. An article housing section for storing articles, an article capturing section for capturing an article in the article housing section, lifting device for moving the article capturing section up and down, control device for controlling the movement of the article capturing section by the lifting device, and detection device for detecting that the article capturing section being moved downward by the lifting device strikes against any object including the article in the article housing section are provided. The control device performs control for operating the lifting device to continue to move the article capturing section downward even after the control device receives a detection signal from the detection device, and after the continued downward movement, stopping the downward movement of the article capturing section.

8 Claims, 33 Drawing Sheets

ARTICLE CAPTURING GAME MACHINE

CROSS-REFERENCE TO RELATED APPLICATIONS

This application is the U.S. national phase of the International Patent Application No. PCT/JP2008/052295 filed Feb. 13, 2008, which claims the benefit of Japanese Application No. 2007-034051 filed Feb. 14, 2007, the entire content of which is incorporated herein by reference.

BACKGROUND OF THE INVENTION

1. Technical Field

The present invention relates to an article capturing game machine. More particularly, the present invention relates to an improvement in game machines for a play in capturing an article such as a prize using, for example, a pair of arms that opens and closes.

2. Description of Related Art

Game machines such as crane game machines aiming to capture a prize (e.g., a stuffed toy) or an article exchangeable for the prize stored in a case (hereinafter called article capturing game machines) are interesting to manipulate, and because popular characters are used as prizes, motivation of players to challenge the game increases. Therefore, many article capturing game machines are installed in general stores, shopping malls, etc., as well as game arcades. Conventionally, various types of article capturing game machines have been proposed and commercialized.

As the above-mentioned article capturing game machines, machines with a pair of opening/closing arms having claws and provided in a UFO-shaped device, for example (hereinafter called a prize capturing section or an article capturing section), are often employed. In this case, the article capturing section first moves horizontally inside the case in response to players manipulation, and causes the arms to open and close directly below the position. Then, it further moves to a position directly above an article dispensing hole, and causes the arms to open and close again. During such a sequence of actions, if an article can be grasped and lifted in the claws at the tips of the arms, for example, and carried to a position directly above the article dispensing hole without being dropped down, the player can get the article.

In the case of such an article capturing game machine, the article capturing section is on standby at an initial position (home position) such as a position directly above the article dispensing hole consisting of an article chute guide and the like at any time except during a game. After the start of the game, when the article capturing section moves horizontally inside the case, the article capturing section often moves while keeping the same height as the initial position. The article capturing section that has moved horizontally to the position intended by the player comes downward at the position, and after completion of opening and closing actions nearby a target article, it goes up. Then, when moving up to the position directly above the article chute guide, it performs the opening and closing actions again, and after that, it returns to the initial position as the home position (for example, see Patent Document 1).

In the meantime, in the above-mentioned article capturing game machines, since the level of difficulty in playing the game varies depending on the layout of articles, such as inclination, quantity, stacking pattern, etc., the user side (e.g., service providing side such as a game arcade or a store) often tries various layouts. In view of how to attract the attention and interest of customers (players), diversified display patterns have emerged, such as to pile up many articles and to arrange an article beside an article drop hole.

Patent Document 1: Japanese Patent Application Laid-Open No. 2004-255172

SUMMARY OF THE INVENTION

Problem to be Solved by the Invention

However, since the movement of the article capturing section is rather standardized without significant change from the conventional ones, whereas the display of articles has been diversified with various ideas and devices as mentioned above, it cannot respond to such diversification of display patterns in some cases. Specifically, a layout in which an article is arranged in the article drop hole itself in a way that seems easy to get them as well as the traditional layout in which articles are just piled up, or more specifically, a layout in which a hand(s) of a character, for example, is hanging on the edge of the article drop hole and only the upper body is sticking out, is becoming common. On the other hand, there has been little change from the conventional ones in the operating mechanism and operational processing for the article capturing section. In such a situation, it may not be enough to realize a further interesting and attractive game even if the way of display is diversified.

Therefore, it is an object of the present invention to provide an article capturing game machine capable of meeting diversified display patterns such as a case where a prize is hooked on an article drop hole.

Means for Solving the Problem

The inventors have conducted various studies to solve such a problem. For example, in the case of conventional article capturing game machines, as a general mechanism of a device (lifting device) for moving the article capturing section up and down, plural pipes of different diameters are combined to construct a retractable support member, and the article capturing section is moved up and down in a state of being suspended from the lower end of the support member. In this case, the article capturing section is suspended by a wire, and the wire is reeled to move the article capturing section upward or unreeled to cause the article capturing section to move downward under its own weight. When the article capturing section being moved downward stops because it rests on an article or strikes against the upper face of a board (placement section) on which articles are placed, a sensor (e.g., limit switch) detects that the article capturing section becomes a so-called bottomed state. After detection, unreeling of the wire may be stopped immediately.

On the other hand, an article hooked on the article drop hole as mentioned above seems easy to drop, but as a matter of fact, it is often hard to drop. In such a case, it is often hard to drop the article into the article drop hole as long as some external load is applied to push the article into the article drop hole. It is common practice to arrange articles in a manner not to be easy to drop (capture) in consideration of grabbing player's attention.

As display is diversified, such a layout is becoming common. In view of this point, the inventors have conducted studies in consideration of the mental state on the side of players playing a game, and have gained new knowledge that lead to solutions to such a problem. The present invention is based on the knowledge and includes: an article housing section for storing a plurality of articles; an article capturing section for capturing an article in the article housing section;

lifting means for moving the article capturing section up and down; control means for controlling the movement of the article capturing section by the lifting means; and detection means for detecting that the article capturing section being moved downward by the lifting means strikes against any object including the article in the article housing section, wherein the control means performs control for operating the lifting means to continue to move the article capturing section downward even after the control means receives a detection signal from the detection means, and after the continued downward movement, stopping the downward movement of the article capturing section.

In general, in the conventional article capturing game machines, the lifting device may be stopped immediately after the article capturing section is bottomed out as mentioned above (or the lifting device may be driven in the reverse direction to move the article capturing section upward). In this case, the weight (self weight) of the article capturing section is not fully exerted on an article as a load. In other words, even if the weight of the article capturing section is 1 kg, only a load of about 700 g is exerted on an article as a target to be captured, for example. If the lifting device is stopped immediately after the article capturing section is bottomed out (state where it reaches a downward travel limit), enough load cannot be exerted any longer. In this regard, an article capturing game machine according to the present invention is such that even if the bottomed state of the article capturing section being moved downward is detected, the lifting device goes into the next action (for example, an action to stop the downward movement of the article capturing section) after a certain time lag without being stopped immediately. This makes it possible to exert a load, for a longer time, on an article hooked on an article drop hole, for example. Since the time lag is inserted between the time of the bottomed state and the time of stopping the downward movement by the lifting device, the article capturing section suspended by a support member (or a wire, for example) is released to the extend and rests on an article, enabling the article capturing section to act sufficiently on the article under its own weight. As mentioned above, a force (load) that can act in the conventional action has an upper limit, whereas the article capturing game machine according to the present invention can exert a load that exceeds the upper limit. In addition, the load can continue to act for a certain time. Thus, actions that meet diversified display patterns can be performed, such as to push in an article downward even if the article is hooked on the article drop hole.

It is also preferred that the article capturing game machine further include: moving means for moving the article capturing section horizontally; and position detection means for detecting a horizontal position to which the article capturing section has been moved by the moving means, wherein the control means performs control for determining, through the position detection means, whether the article capturing section is located in a preset, fixed range in the horizontal direction, and if the article capturing section is located in the fixed range, operating the lifting means to continue to move the article capturing section downward even after the control means receives the detection signal from the detection means, and after the continued downward movement, stopping the downward movement of the article capturing section, or if the article capturing section is not located in the fixed range, the control means performs control for stopping the downward movement of the article capturing section in response to receiving the detection signal from the detection means.

It is further preferred that the article capturing game machine further include an article input port provided in the article housing section to input an article in the article housing section, wherein the position detection means detects whether the article capturing section is located in a fixed range above the article input port, and the control means performs control for determining, through the position detection means, whether the article capturing section is located in the fixed range above the article input port, and if the article capturing section is located in the fixed range, operating the lifting means to continue to move the article capturing section downward even after the control means receives the detection signal from the detection means, and after the continued downward movement, stopping the downward movement of the article capturing section.

Further, it is preferred that the article capturing game machine further include adjustment means for adjusting, under the control of the control means, the time or distance from when the lifting means continues to move the article capturing section downward after the control means receives the detection signal until the downward movement is stopped.

Another article capturing game machine according to the present invention includes: an article housing section for storing a plurality of articles; an article capturing section for capturing an article in the article housing section; lifting means for moving the article capturing section up and down; control means for controlling the movement of the article capturing section by the lifting means; detection means for detecting that the article capturing section being moved downward by the lifting means strikes against any object including the article in the article housing section; and operation means for allowing a player to perform control for capturing the article, wherein when receiving an operation signal from the operation means, the control means performs control for operating the lifting means to continue to move the article capturing section downward even after the control means receives a detection signal from the detection means, and after the continued downward movement, stopping the downward movement of the article capturing section.

Thus, in such an article capturing game machine, the control means performs control for operating the lifting means to continue to move the article capturing section downward even after the control means receives the detection signal from the detection means, and after the continued downward movement, stopping the downward movement of the article capturing section. Therefore, a time lag is formed between the time when a player controls the operation means to capture an article and the time when the downward movement of the article capturing section is actually stopped.

Still another article capturing game machine according to the present invention includes: an article housing section for storing a plurality of articles; an article capturing section for capturing an article in the article housing section; lifting means for moving, up and down, the article capturing section being suspended; control means for controlling movement of the article capturing section by the lifting means; and weight detection means for detecting the weight of the article capturing section suspended by the lifting means, wherein the control means performs control for determining, based on a detection signal from the weight detection means, whether the weight reaches a preset, given weight, operating the lifting means to continue to move the article capturing section downward until the weight reaches the given weight, and when the weight reaches the given weight, stopping the downward movement of the article capturing section.

ADVANTAGEOUS EFFECT OF THE INVENTION

According to the present invention, enough push-in load can be exerted on an article hooked on an article drop hole, and this can result in realizing highly interesting actions that meet diversified display patterns.

DESCRIPTION OF REFERENCE NUMERALS AND SYMBOLS

Figure 1:
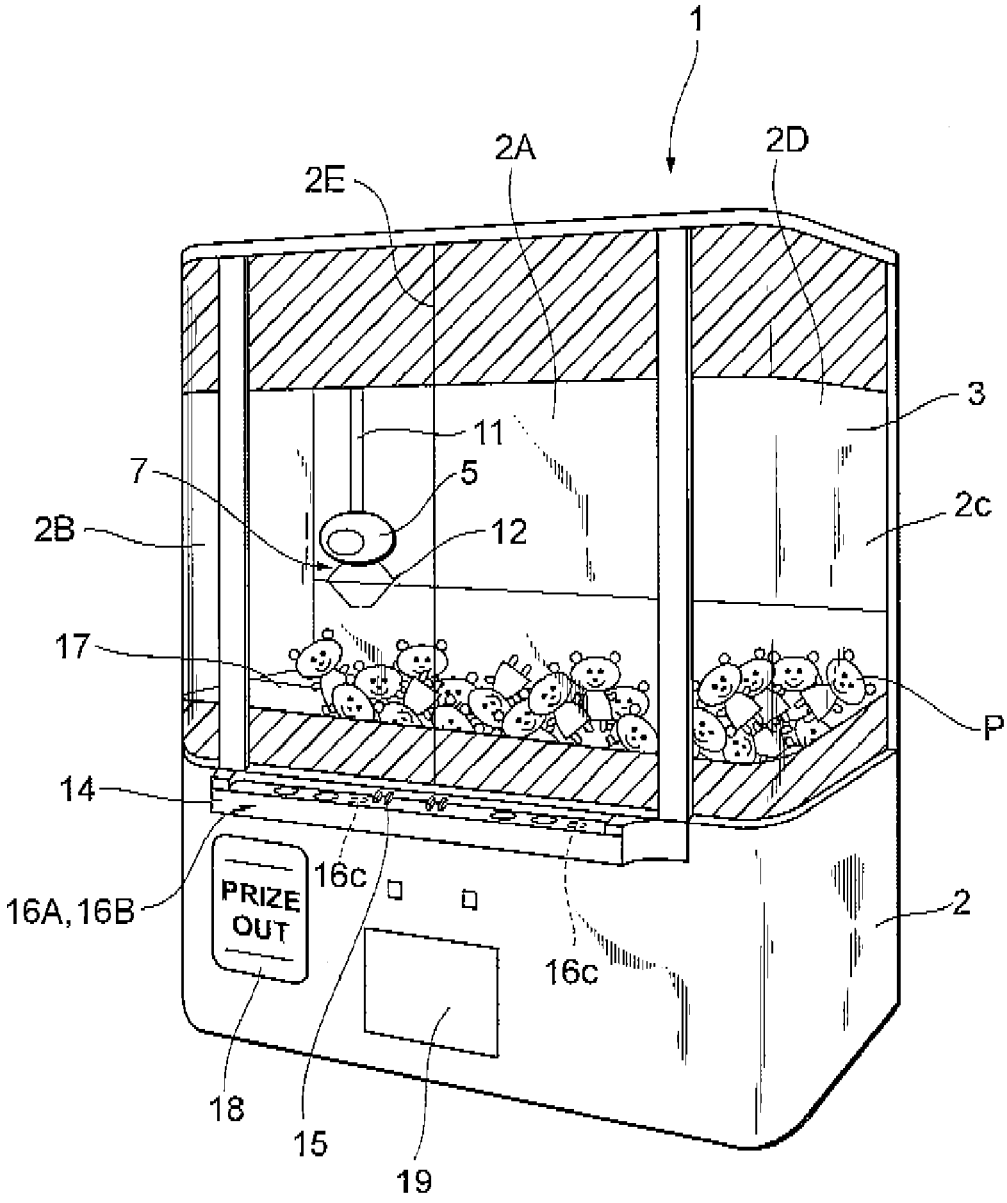
[FIG. 1] It is a perspective view showing the appearance of a prize capturing game machine.

1 . . . Prize capturing game machine (Article capturing game machine), 2 . . . Base, 2A . . . Front face, 2B . . . Side face, 2C . . . Side face, 2D . . . Back face, 2E . . . Door, 3 . . . Housing section (Article housing section), 3*a* . . . Placement surface, 5 . . . Prize capturing section (Article capturing section), 6 . . . Moving section (Moving means),

6X . . . X-direction motor, 6Y . . . Y-direction motor, 6Z . . . Z-direction motor, 7 Grasping part, 8 . . . Lateral fixed rail, 9 . . . . Longitudinal movable rail, 10 . . . Prize capturing base, 11 . . . Support member, 12 . . . Arm, 13 . . . Claw, 14 . . . Control panel, 15 . . . Coin slot,

16 . . . Operating section, 16A . . . First operation switch, 16B . . . Second operation switch, 16C . . . push-in instruction switch, 17 . . . Prize chute guide, 17*a* . . . Prize drop hole (Article input port), 18 . . . Outlet, 19 . . . Opening/closing door, 20 . . . Motor, 21 . . . Arm opening/closing member, 21A . . . Spring receiving member, 22 . . . . Spring section, 23 . . . Cover, 24 . . . Proximal member, 25 . . . Bracket,

26 . . . Pinion, 27 . . . Rack, 28 . . . Coil spring, 28A . . . One end of coil spring, 28B . . . The other end of coil spring, 29 . . . Pin,

29A . . . One end of pin, 29B . . . The other end of pin, 29C . . . Locking portion of pin, 30 . . . Control section (Control means), 31 . . . Memory section, 32 . . . Communication section, 33 . . . Timer, 34 . . . Limit switch (Detection means), 35 . . . Coupler, 36 . . . Bracket, 37 . . . Lifting device (Lifting means), 38 . . . Carrier, 39 . . . Reeling/unreeling device, 40 . . . Wire, 41 . . . Wire motor, 42 . . . Worm, 43 . . . Worm gear, 44 . . . Wire reel, 45 . . . Guide reel, 46 . . . Spindle, 47 . . . Swing arm, 48 . . . Spring, 49 . . . Connector, 49*a* . . . Receiving hole, 50 . . . Second guide reel, 51 . . . Switch actuator, 52 . . . Mandrel, 53 . . . Coil spring,

54 . . . Cable, 55 . . . RFIC reader, 56 . . . Switch panel, 60 . . . Treadle, 61 . . . Fulcrum, 62 . . . Long hole, 63 . . . Slider, 64 . . . Detection timing delay means, 70 . . . Topping sensor (Detection means),

71 . . . Light shielding plate, 72 . . . Torsion coil spring, 73 . . . Frame, 74 . . . Screw, 75 . . . Torsion coil spring, 80 . . . Bottoming sensor (Detection means), 81 . . . Light shielding plate, 82 . . . Swinging member, 83 . . . Swing frame, P . . . Prize (Article).

DETAILED DESCRIPTION OF PREFERRED EMBODIMENT

The structure of the present invention will now be described in detail based on examples of embodiments shown in the drawings.

FIG. 1 to FIG. 34 show an embodiment of the present invention. A prize capturing game machine 1 according to the present invention includes a prize capturing section 5 that moves in a predetermined space in response to external operations, arms 12 attached to the prize capturing section 5 in an operable and closable manner to grasp a prize P to be captured or release the grasped prize P from above a prize drop hole 17*a* of a prize chute guide 17, a lifting device 37 for moving the prize capturing section 5 up and down, a limit switch 34 for detecting that the prize capturing section 5 is bottomed out during the downward movement, and a control section 30 for controlling the operation of the lifting device 37, enabling to play a game for grasping and capturing the prize P. The prize capturing game machine 1 of the embodiment is also such that a time lag is inserted between the time when the limit switch 34 detects that the prize capturing section 5 is bottomed out and the time when the lifting device 37 goes into the next action.

The following first describes the general structure of the prize capturing game machine 1 according to the embodiment, and then the internal structure of the prize capturing game machine 1. After that, description will be made about a structure for adjusting an initial position of the prize capturing section 5, a structure for moving a control panel 14 up and down, and the structure of a treadle 60, and further a structure for pushing in the prize P.

(1) General Structure of Prize Capturing Game Machine 1

In FIG. 1, reference numeral 1 designates the prize capturing game machine of the embodiment as a whole, where a box housing 3 is provided on a base 2 having the shape of a rectangular solid A front face 2A and side faces 2B, 2C of the housing 3 are formed of transparent resin or glass plate members to allow a player to view the prize P housed inside. A back face 2D is formed of a specular surface-like plate member or a decorated plate member. A sliding door or double door 2E is provided on the front face 2A of this housing 3 so that a user (e.g., a store clerk) can open this door 2E to store, in the housing 3, stuffed toys such as characters or prizes such as miscellaneous goods.

Further provided in the housing 3 are the prize capturing section 5 provided with a grasping part 7 for grasping a prize P, and a moving section 6 (see FIG. 2) for moving this prize capturing section 5 under the control of a player.

Figure 2:
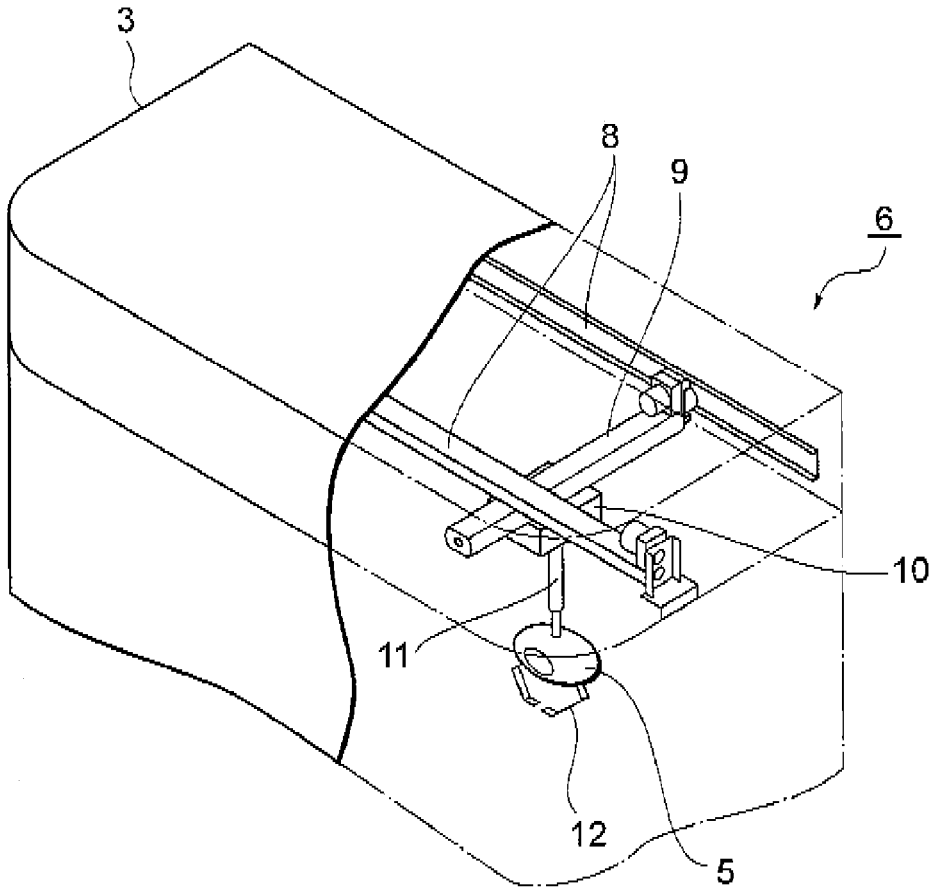
[FIG. 2] It is a perspective view showing the structure of a moving section.

As shown in FIG. 2, the moving section 6 as moving means for moving the article capturing section 5 horizontally has a pair of lateral fixed rails 8 internally arranged in an upper portion of the housing 3 in parallel with the lateral direction (X direction), a longitudinal movable rail 9 slidably attached to the lateral fixed rails 8 in parallel with the longitudinal direction (Y direction), a base 10 for the prize capturing section, which is slidably attached to this longitudinal movable rail 9, and a support member 11 attached to this prize capturing base 10 to be retractable in parallel with the vertical direction (Z direction). The prize capturing section 5 is attached to the lower end of this support member 11. Though not particularly shown, the moving section 6 further includes, as means for detecting the horizontal position of the prize capturing section 5, an encoder for detecting a rotational speed corresponding to a travel distance of the prize capturing section 5 moved in the X direction and Y direction by means of an X-direction motor 6X and a Y-direction motor 6Y, or a sensor or switch for detecting whether to be within or beyond a fixed range.

Figure 7:
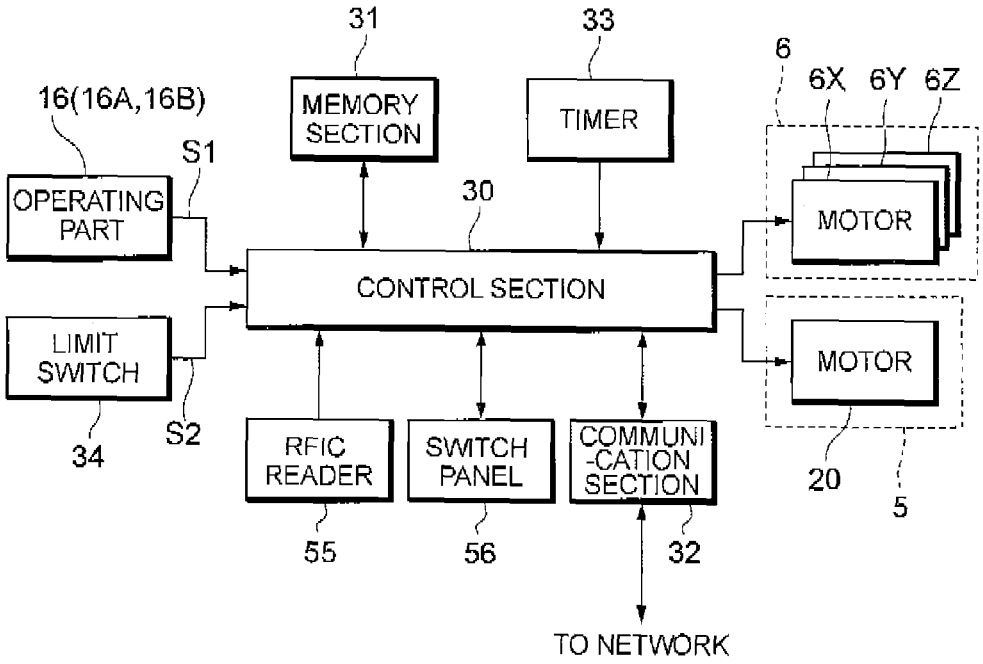
[FIG. 7] It is a block diagram showing an internal structure of the prize capturing game machine.

In this case, the longitudinal movable rail 9 of the moving section 6 can be made to move in the lateral direction (X direction) along the lateral fixed rails 8 based on the rotation output of the X-direction motor 6X (FIG. 7), and the base 10 for the prize capturing section can be made to move in the longitudinal direction (Y direction) along the longitudinal movable rail 9 based on the rotation output of the Y-direction motor 6Y (FIG. 7). Further, the support member 11 can be made to extend and retract based on the rotation output of the Z-direction motor 6Z (FIG. 7). These X-direction motor 6X, Y-direction motor 6Y, and Z-direction motor 6Z of the moving section 6 are operated in a desired state to make the prize capturing section 5 to move to a desired position in the housing 3.

Further, the prize capturing section 5 has two arms that are openable and closable, to each distal end of which a claw 13 (FIG. 3) is attached, respectively. These arms 12 can be opened and closed to grasp a prize P. In this case, each arm 12 is attached replaceably to the prize capturing section 5, and each claw 13 is attached replaceably to each corresponding arm 12. Thus, these arms 12 and claws 13 can be replaced to adjust the level of difficulty in playing the game.

On the other hand, a control panel 14 as a console is provided on the base 2. Provided in this control panel 14 are a coin slot 15 for dropping a coin(s) upon playing a game, and an operating part 18 consisting of a first operation switch 16A for operation input to enable the player to move the prize capturing section 5 to a desired position in the lateral direction during the game and a second operation switch 16B for operation input to allow the player to move the prize capturing section 5 to a desired position in the longitudinal direction after that. This operating part can also be constructed by another operative means such as a joy-stick.

A prize outlet 18 communicating with the prize chute guide 17 having a cylindrical shape and provided in a predetermined position inside the housing 3 is provided on the front side of the base 2 so that the prize P grasped by the prize capturing section 5, carried and dropped into the prize chute guide 17 can be gotten out of the prize outlet 18.

An opening/closing door 19 is also provided on the front side of the base 2. Inside this opening/closing door 19, a switch panel 56, a liquid crystal touch panel, etc. (not shown) for various settings of this prize capturing game machine are so housed that the management staff can set various items to desired conditions while visually checking the display contents of the switch panel 56 and the liquid crystal touch panel.

Figure 3:
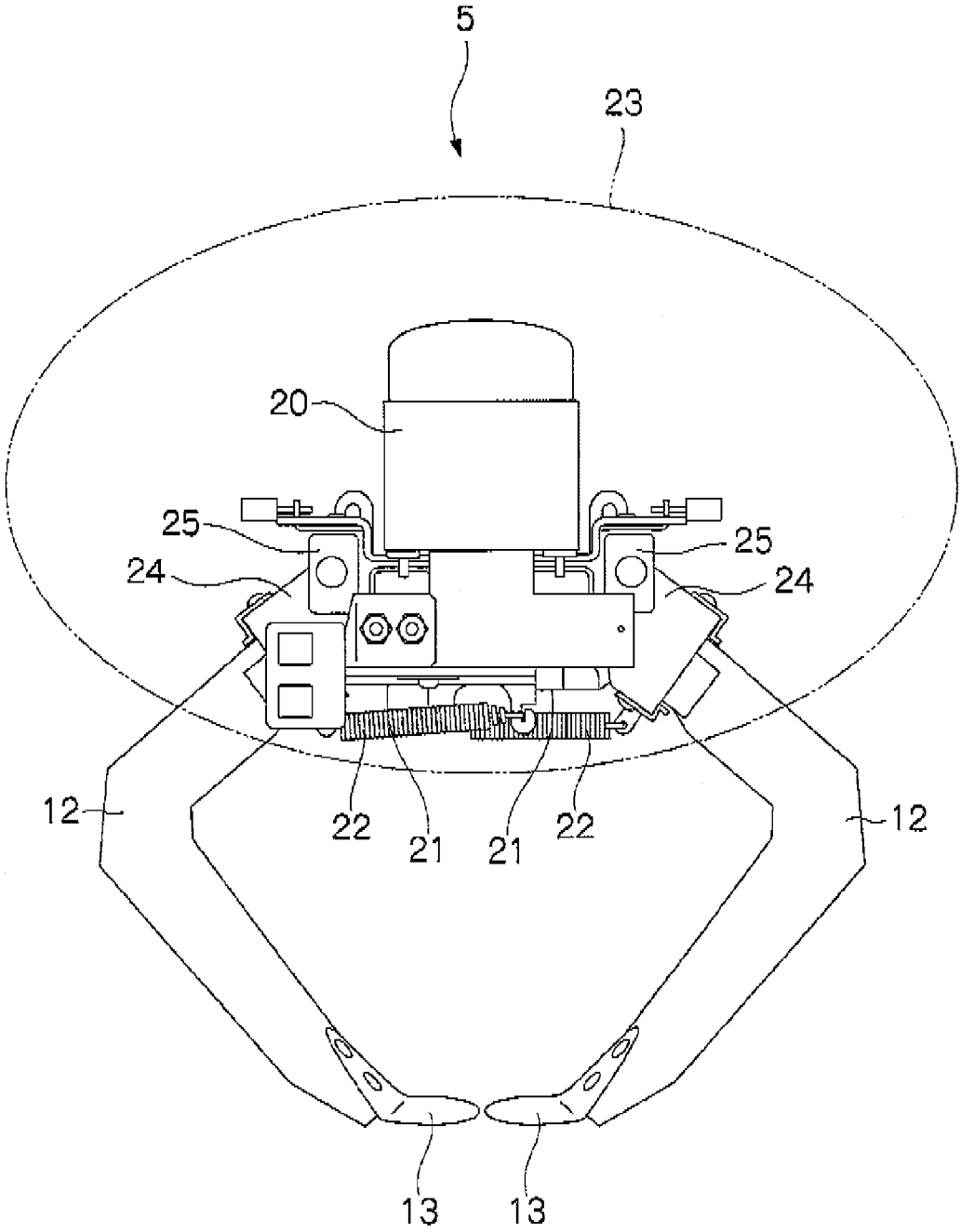
[FIG. 3] It is a front view showing the structure of a prize capturing section.
Figure 4A:
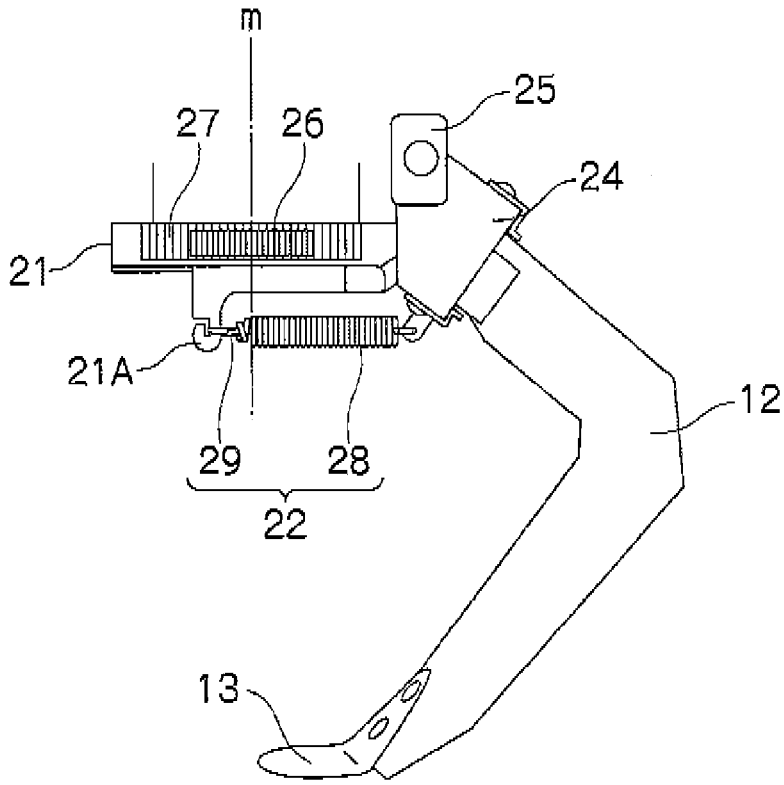
[FIG. 4A] It is a front view showing the structure of the prize capturing section.
Figure 4B:
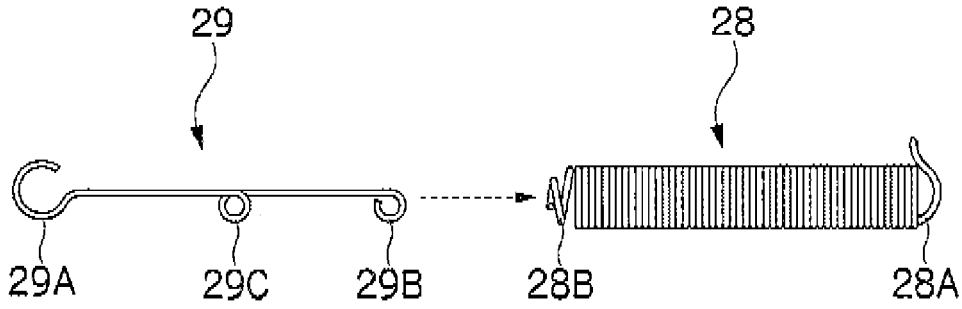
[FIG. 4B] It is an exploded view showing the structure of the prize capturing section.

FIG. 3, FIG. 4A and FIG. 4B show a specific structure of the prize capturing section 5. As also apparent from FIG. 3, the prize capturing section 5 has a motor 20 as a power source, arm opening/closing members 21 for driving the arms 12 to open and close based on the rotary output of this motor 20, and spring parts 22 for determining the maximum grasping force when the prize P is grasped by the arms 12, where a part including the motor 20 is covered with a cover 23. Each arm 12 is removably attached to a bracket 25 through a proximal member 24 in such a manner to be movable obliquely with respect to the bracket 25, and the claws 13 are screwed onto open ends of these arms 12, respectively.

Further, as shown in FIG. 4A, a pinion 26 is attached to the distal end of an output shaft of the motor 20, and a rack 27 is fixed to the inner face of the arm opening/closing member 21 in parallel with the spring part 22 in such a manner to engage with this pinion 26. Thus, the motor 20 is driven to rotate in the forward or reverse direction so that the arm opening/closing member 21 can be moved together with the rack 27 in a direction toward the proximal member 24 or in the reverse direction.

As shown in FIG. 4B, the spring part 22 consists of a coil spring 28 and a rod-shaped pin 29. One end 29A of the pin 29 is attached to a spring receiving member 21A provided in the arm opening/closing member 21. The other end 29B of the pin 29 is inserted in the coil spring 28, and at its end, a curled portion is formed to prevent the end portion from being caught inside the coil spring 28. Further, a locking portion 29G for preventing the pin 29 from falling out of the other end 28B of the coil spring 28 is formed almost in the middle of the pin 29.

In the coil spring 28, the one end 28A is attached to the proximal member 24 of the arm 12, and the pin 29 is inserted from the other end 28B. The diameter of the other end from which the pin 29 of this coil spring 28 is inserted is made small, and this can prevent the pin 29 from falling out.

According to such a structure, when the proximal member 24 is pressed by the arm opening/closing member 21 to move in a direction to open the arm 12 during the opening of the arm 12, the pin 29 moves in the open direction without extending the coil spring 28 until the locking portion 29C of the pin 29 reaches the other end 28B of the coil spring 28, and this can prevent the coil spring 28 from extending and hence generating a biasing force. Further, when the spring receiving member 21A provided in the arm opening/closing member 21 moves due to the movement of the rack 27 to extend the coil spring 28, only the pin 29 moves together with the arm opening/closing member 21A until the locking portion 29C reaches the other end 28B of the coil spring 28, and this can prevent the coil spring 28 from extending.

In such a state that the locking portion 29C has reached the other end 28B of the coil spring 28, a portion from the locking portion 29C of the pin 29 to the other end 29B is inserted in the coil spring 28, and this can prevent the coil spring 28 from being loosened.

Figure 5A:
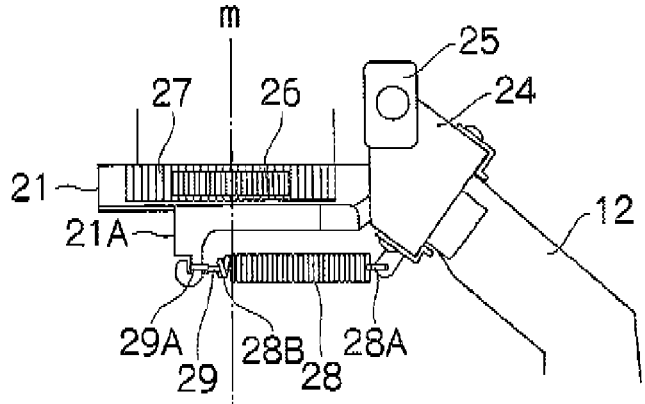
[FIG. 5A] It is a front view for describing the operation of the prize capturing section.

Next, the opening and closing of the arms 12 in this prize capturing section 5 will be described. In the initial state, the arm 12 is closed in this prize capturing section 5. Further, as shown in FIG. 5A, most part of the pin 29 of the spring part 22 is located inside the coil spring 28.

Figure 5B:
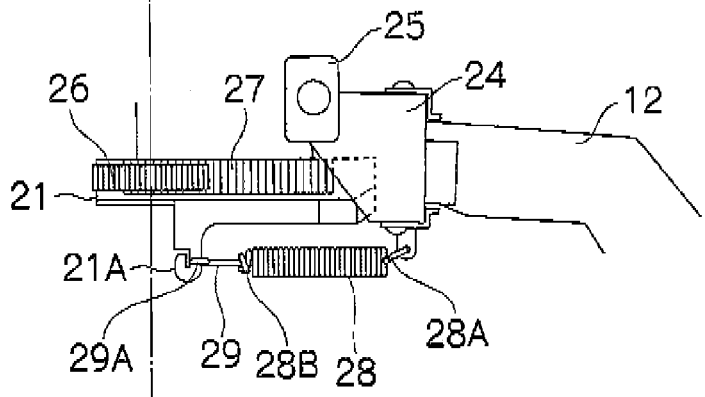
[FIG. 5B] It is a front view for describing the operation of the prize capturing section.

Then, as shown in FIG. 5B, upon opening action of the arm 12, the motor 20 is driven to rotate in the forward direction to rotate the pinion 26 clockwise, so that the rack 27 and the arm opening/closing member 21 move toward the proximal member 24. As a result, the proximal member 24 is pushed by one end of the arm opening/closing member 21 to open the arm 12.

Figure 5C:
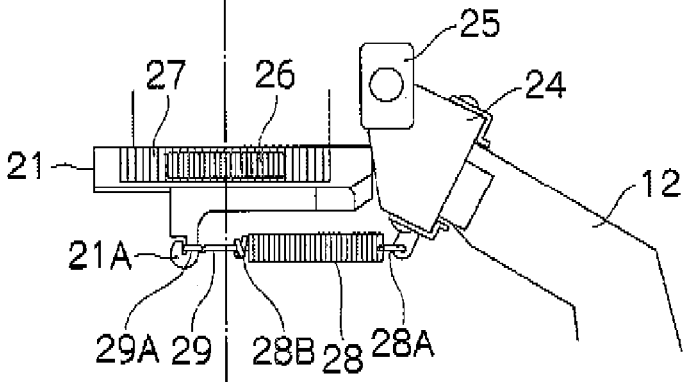
[FIG. 5C] It is a front view for describing the operation of the prize capturing section.

On the other hand, as shown in FIG. 5C, upon closing action of the arm 12, the motor 20 is driven to rotate in the reverse direction to rotate the pinion 26 counterclockwise, so that the rack 27 and the arm opening/closing member 21 move toward the center of the prize capturing section 5. As a result, the arm 12 is closed along with the movement of this arm opening/closing member 21. The motor 20 continues to rotate until the rack 27 and the arm opening/closing member 21 come to the position in the initial state of FIG. 5A.

FIG. 5C shows a state of the prize capturing section 5 when a prize P is grasped by the two arms 12. As compared with the state of FIG. 5A, the state of FIG. 5C is that the coil spring 28 is not extending despite the fact that a portion of the pin 29 is further extending from the inside of the coil spring 28. Thus, even when the arms 12 grasp the prize P, the pin 29 can function to zero out the biasing force by the coil spring 28.

Figure 5D:
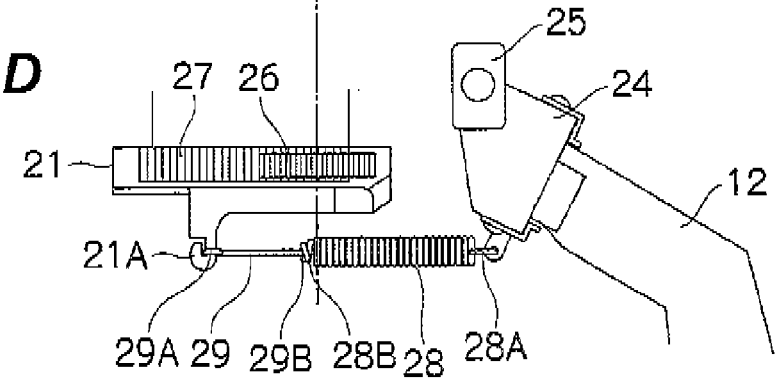
[FIG. 5D] It is a front view for describing the operation of the prize capturing section.

Subsequently, as shown in FIG. 5D, the motor 20 continues the reverse rotation after the rack 27 returns to the position in the initial state, so that the arm opening/closing member 21 further moves in a direction to separate from the proximal member 24 and hence the pin 29 moves in the same direction as well. As a result, the locking portion 290 of the pin 29 is engaged with an end portion of the coil spring 28. In this engaged state, if the pin 29 further moves, the coil spring 28 extends to bias the arm 12 in a direction to close the arm 12 so that not only the grasping force of the grasping part 7 of the prize capturing section 5 is increased, but also the biasing force can be changed analogously according to the travel distance of the rack 27.

Figure 6A:
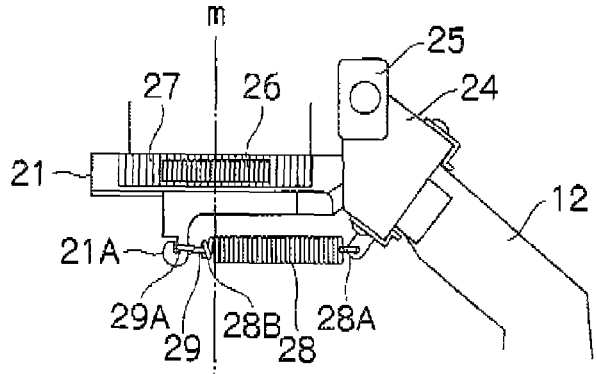
[FIG. 6A] It is a front view for describing the operation of the prize capturing section.
Figure 6B:
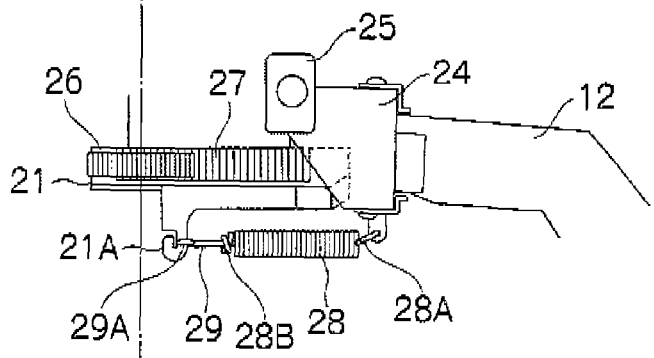
[FIG. 6B] It is a front view for describing the operation of the prize capturing section.

FIG. 6A to FIG. 6D show a state of the prize capturing section 5 when the prize capturing section 5 grabs a prize P bigger than the prize P grabbed in FIG. 5A to FIG. 5D. Therefore, since the flow from FIG. 6A to FIG. 68 is the same as that from FIG. 5A to FIG. 58, the description thereof will be omitted. After an opening action of the arm 12, the rotation of the motor 20 is reversed to start a closing action of the arm 12. Here, though the arms 12 grasp the prize P, the open angle of the arms 12 becomes large because the prize P is big. As a result, the end 288 of the coil spring 28 is pulled toward the center, and when the locking portion 29C of the pin 29 is engaged with the end 28B of coil spring 28, a biasing force is exerted.

After that, if the motor 20 further continues the reverse rotation, the arm opening/closing member 21 further moves in the direction to separate from the proximal member 24. As a result of this movement, the pin 29 also moves in the direction to separate from the proximal member 24. As a result, as shown in FIG. 6D, since the coil spring 28 further expands, the grasping force of the prize capturing section 5 can be increased.

Figure 6C:
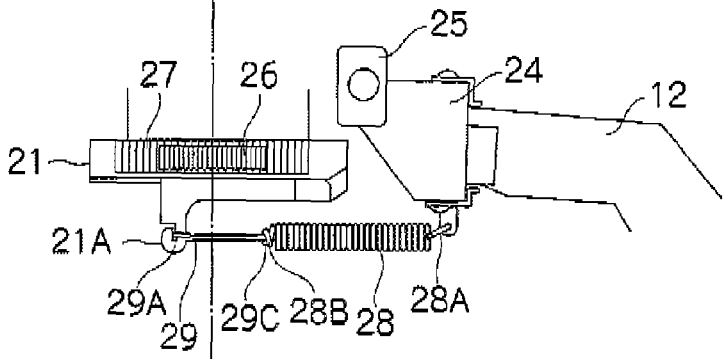
[FIG. 6C] It is a front view for describing the operation of the prize capturing section.
Figure 6D:
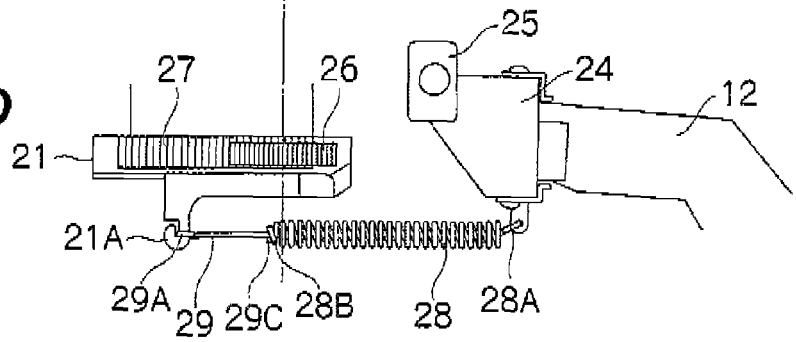
[FIG. 6D] It is a front view for describing the operation of the prize capturing section.

The rotation of the motor 20 after the rack 27 and the arm opening/closing member 21 return to the initial position like in FIG. 5C or FIG. 6C is controlled by the control section 30 to be described later based on the setting of the grasping force by the management staff. In other words, if the grasping force is set to "100" as the maximum value, the motor 20 is so rotated that the arm opening/closing member 21 travels the maximum distance in the direction to separate from the proximal member 24. If the grasping force is set to "1" as the minimum value, the rotation of the motor 20 is stopped when the arm opening/closing member 21 returns to the initial position. If the grasping force is set to a value in a range from "100" to "1," the motor 20 is so rotated that the arm opening/closing member 21 travels a distance corresponding to the set value in the direction to separate from the proximal member 24.

The grasping force of the prize capturing section 5 can be set up by entering a desired numeric value in the range from 1 to 100. As setting input means for entering such a set numeric value for the grasping force of the prize capturing section 5, setting input means other than the liquid crystal touch panel may be provided separately.

Thus, in this prize capturing game machine 1, the setting of a numeric value for the grasping force in the prize capturing section 5 and the type (strong, moderate, weak) of coil spring 28 of the spring part 22 can be adjusted to set, to a desired magnitude, the grasping force when the prize P is grasped by the two arms 12.

FIG. 7 shows an internal structure of this prize capturing game machine 1. As apparent from FIG. 7, this prize capturing game machine 1 has the control section 30 with a microcomputer configuration including a CPU (Central Processing Unit), a ROM (Read Only Memory), and a RAM (Random Access Memory), a memory section 31 as a non-volatile memory, for example, a communication section 32 as an interface for communicating with external devices through a network, and a timer 33 for counting current time. Though a detailed description will be omitted in this specification, reference numeral 55 in FIG. 7 designates an RFID reader for reading the recording content (part classification information, part type information, or prize identification code) of an RFID chip attached to the tag of each prize P, and reference numeral 56 designates a switch panel provided inside the opening/closing door 19 to make various settings, etc. for the prize capturing game machine 1.

Then, for example, when the first or second operation switch 16A or 16B on the control panel 14 (FIG. 1) is pressed by the player during the game, a corresponding actuating signal S1 is given to the control section 30 from the first or second operation switch 16A or 16B. In the moving section 6, limit switches 34 are provided respectively, for example, in X-direction, Y-direction, or Z-direction travel limit positions of the prize capturing section 5 as lateral position detection means for detecting the position of the prize capturing section 5 in the lateral direction, longitudinal position detection means for detecting the longitudinal position, and vertical position detection means for detecting the vertical position. When the prize capturing section 5 moves to a corresponding X-direction, Y-direction, or Z-direction travel limit position, these limit switches 34 send out a travel limit detection signal S2 corresponding to this movement to the control section 30, respectively.

Figure 8:
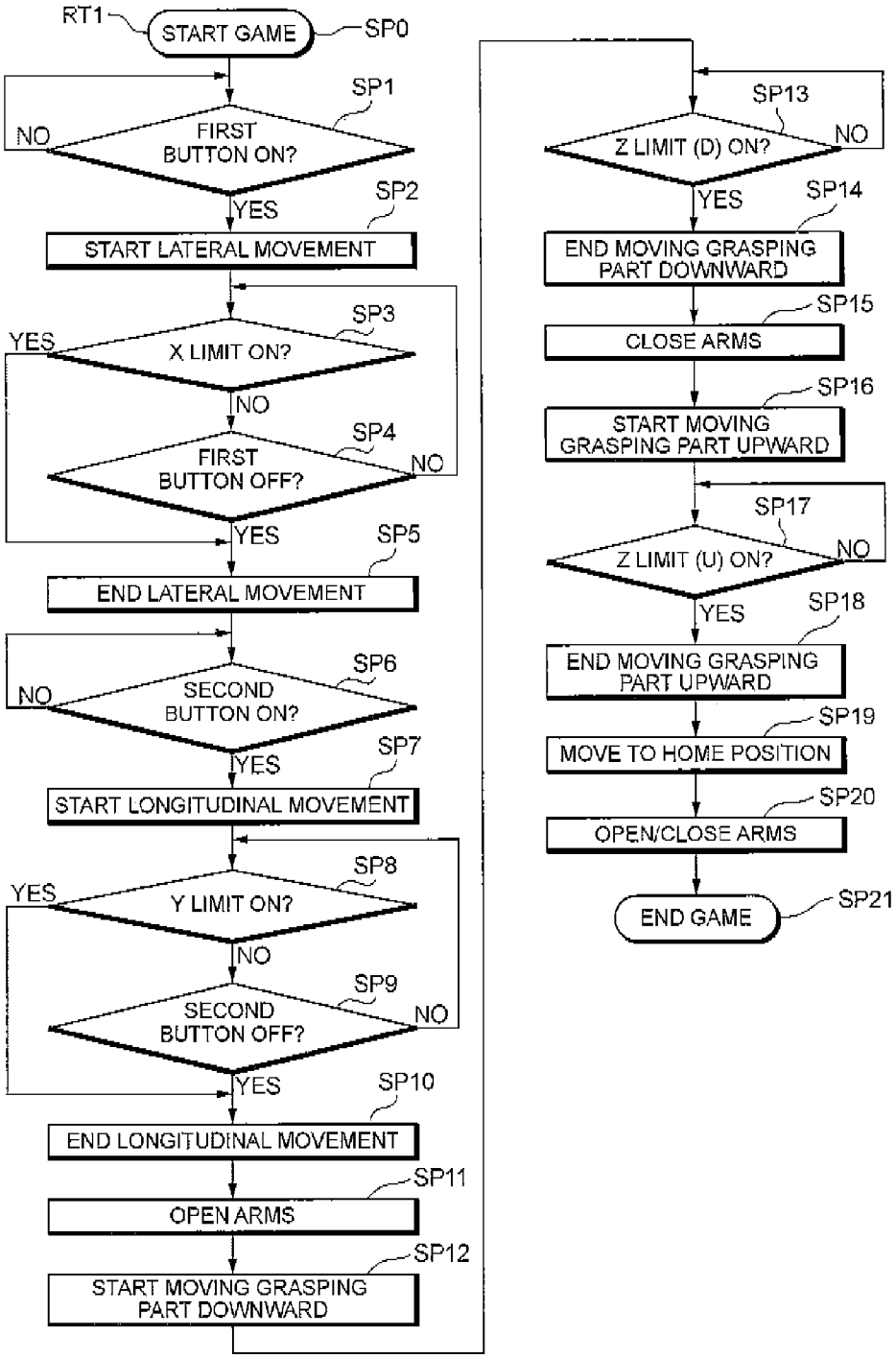
[FIG. 8] It is a flowchart showing a prize capturing game execution procedure.
Figure 9:
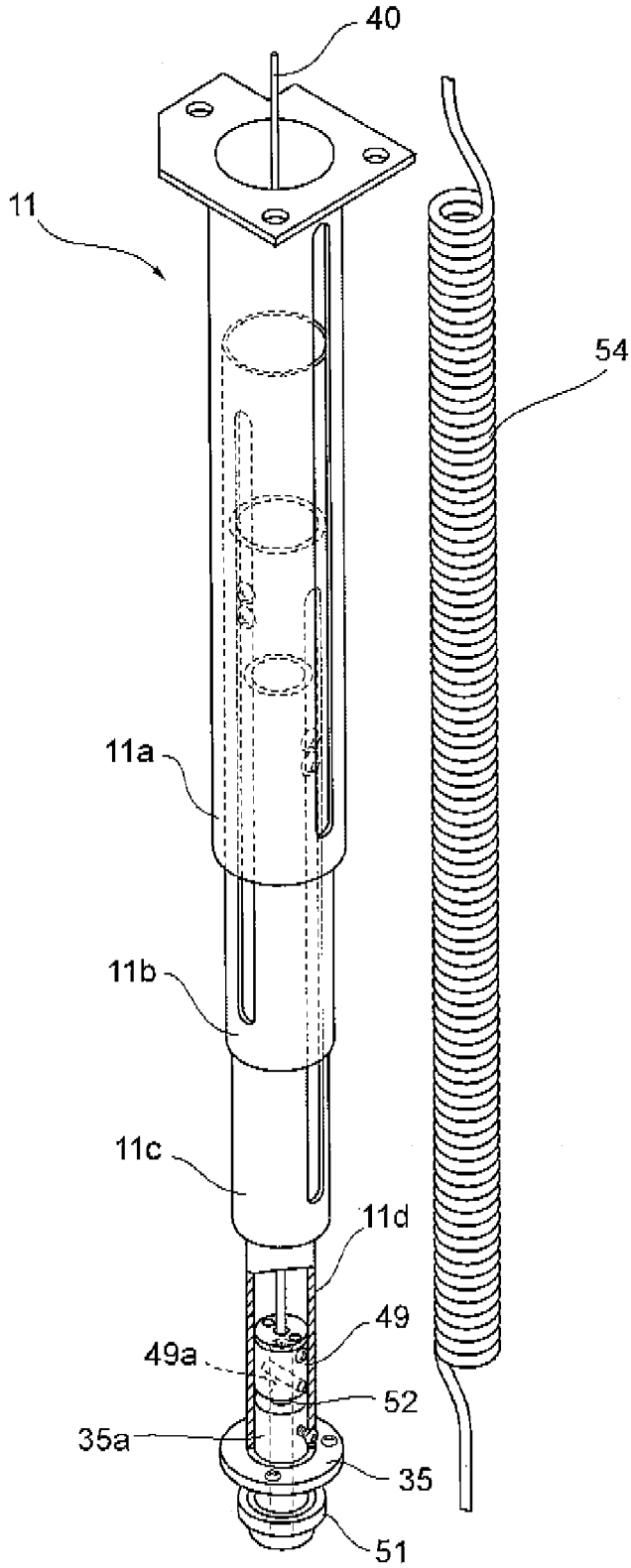
[FIG. 9] It is a perspective view showing an example of the structure of a support member consisting of expansion pipe, etc.
Figure 10:
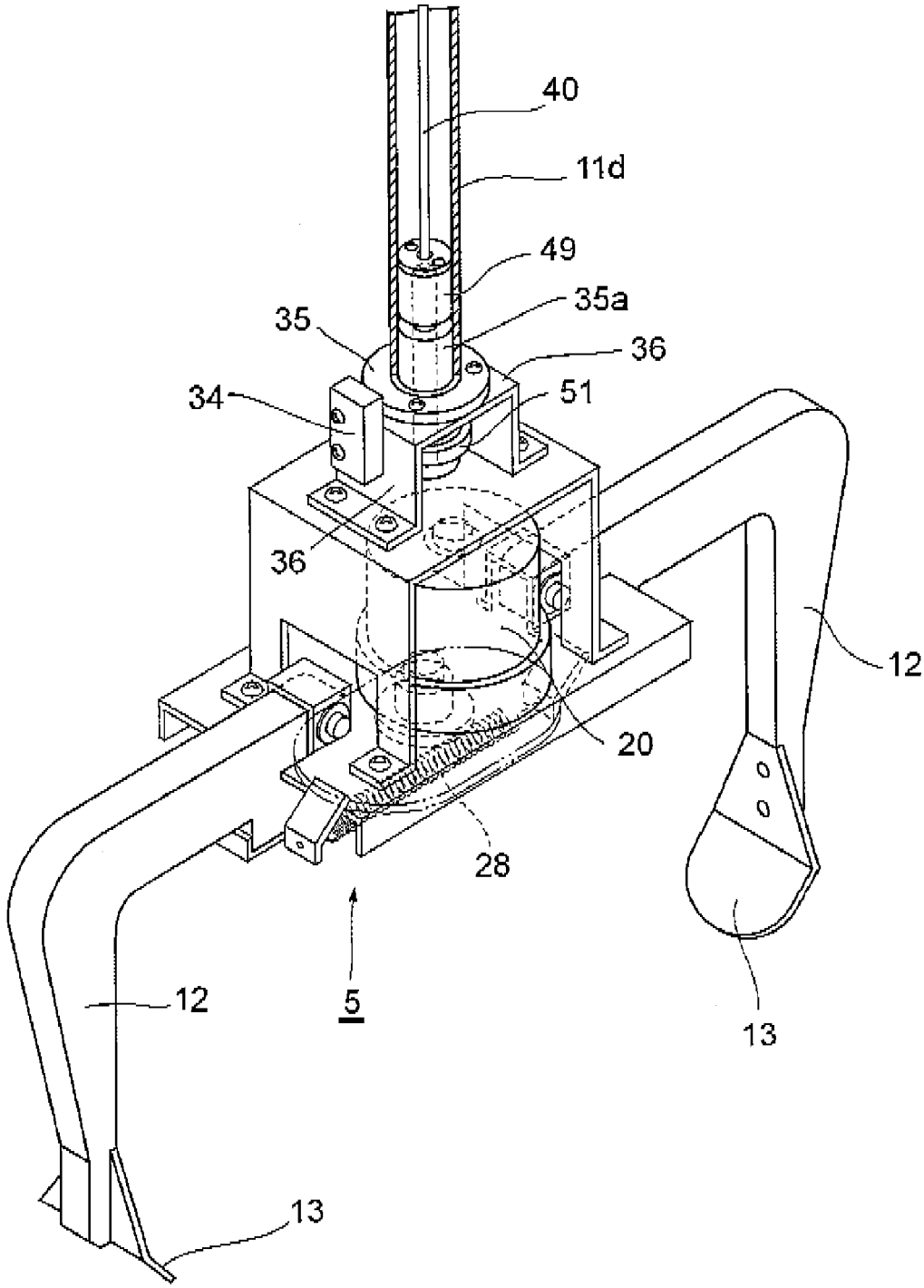
[FIG. 10] It is a perspective view showing an example of a structure including the prize capturing section.

Thus, based on these operation signal S1 and travel limit detection signal S2, the control section 30 causes the prize capturing game machine 1 to perform game actions corresponding to player's operations of the first and second operation switches 16A and 16B according to a prize capturing game execution procedure RT1 shown in FIG. 8.

In other words, when recognizing that a preset number of coins for one play are inserted into the coin slot 15 (FIG. 1), the control section 30 starts this prize capturing game execution procedure RT1 in step SP0, and in the subsequent step SP1, it waits for pressing of the first operation button 16A (FIG. 1) on the control panel 14 (FIG. 1).

Then, when recognizing later that the player has pressed the first operation button 16A based on the operation signal S1 from the first operation button 16A, the control section 30 proceeds to step SP2 to activate the X-direction motor 6X of the moving section 6 (FIG. 2) in order to start lateral (X-direction) movement of the prize capturing section 5 located at the home position right above the prize chute guide 17 (FIG. 1) in the initial state.

Next, the control section 30 proceeds to step SP3, and based on the travel limit detection signal S2 from the corresponding limit switch 34, it determines whether the prize capturing section 5 finishes its travel to the travel limit position in the lateral direction. In the subsequent step SP4, the control section 30 determines, based on the operation signal S1 from the first operation button 16A, whether pressing of the first operation button 16A has been released. If a negative result is obtained in these steps SP3 and SP4, the control section 30 returns to step SP3.

On the other hand, if a positive result is obtained in either step SP3 or step SP4, the control section 30 proceeds to step SP5 to stop the X-direction motor 6X of the moving section 6 in order to end the lateral (X-direction) movement of the prize capturing section 5. After that, the control section 30 proceeds to step SP6 to wait for pressing of the second operation button 16B (FIG. 1) on the control panel 14.

Then, when recognizing later that the second operation button 16B has been pressed based on the operation signal S1 from the second operation button 16B, the control section 30 proceeds to step SP7 to activate the Y-direction motor 6Y of the moving section 6 in order to start longitudinal (Y-direction) movement of the prize capturing section 5.

After that, the control section 30 proceeds to step SP8 to determine, based on the travel limit detection signal 52 from the corresponding limit switch 34, whether the prize capturing section 5 finishes its travel to the travel limit position in the longitudinal direction. In the subsequent step SP9, the control section 30 determines, based on the operation signal S1 from the second operation button 16B, whether pressing of the second operation button 16B has been released. If negative results are obtained in these steps SP8 and SP9, the control section 30 returns to step SP8.

Then, when a positive result is obtained in either step SP8 or step SP9, the control section 30 proceeds to step SP10 to stop the Y-direction motor 6Y of the moving section 6 in order to end the longitudinal (Y-direction) movement of the prize capturing section 5. After that, it proceeds to step SP11 to activate the motor 20 (FIG. 3) of the prize capturing section 5 in order to open the arms 12 of the prize capturing section 5.

After that, the control section 30 proceeds to step SP12 to activate the Z-direction motor 6Z of the moving section 6 in order to start downward movement of the prize capturing section 5. Further, it proceeds to step SP13 to wait for completion of travel of the prize capturing section 5 to the downward travel limit position.

When recognizing later that the prize capturing section 5 finishes its travel to the downward travel limit position based on the travel limit detection signal 52 from the limit switch 34, the control section 30 proceeds to step SP14 to stop the Z-direction motor 6Z of the moving section 14 in order to end the downward movement of the prize capturing section 5. After that, it proceeds to step SP15 to activate the motor 20 of the prize capturing section 5 in order to close the arms 12.

Subsequently, the control section 30 proceeds to step SP16 to activate the Z-direction motor 6Z of the moving section 6 in order to start upward movement of the prize capturing section 5. After that, it proceeds to step SP17 to wait for completion of travel of the prize capturing section 5 to the upward travel limit position.

Then, when recognizing that the prize capturing section 5 has finished it travel to the upward direction travel limit position based on the travel limit detection signal 52 from the limit switch 34, the control section 30 proceeds to step SP18 to stop the Z-direction motor 6Z of the moving section 6 in order to end the upward movement of the prize capturing section 5. After that, it proceeds to step SP19 to activate the X-direction motor 6X and the Y-direction motor 6Y of the moving section 6, respectively, in order to move the prize capturing section 5 to the original home position above the prize chute guide 17.

After that, the control section 30 proceeds to step SP20 to activate the motor 20 of the prize capturing section 5 in order to open the arms 12 of the prize capturing section 5 and close it again (release action of the prize P). After that, it proceeds to step SP21 to end this prize capturing game execution procedure RT1.

Thus, in this prize capturing game machine 1, when the prize capturing section 5 has succeeded in grabbing a prize P, the prize P is carried to a position above the prize chute guide 15 while being grabbed by the arms 12 of the prize capturing section 5, and dropped into the prize chute guide 17 in the release action of the prize P by the prize capturing section 5, so that the player can get the prize P out of the prize outlet 18.

(2) Structure for Adjusting Initial Position of Prize Capturing Section 5

Figure 16:
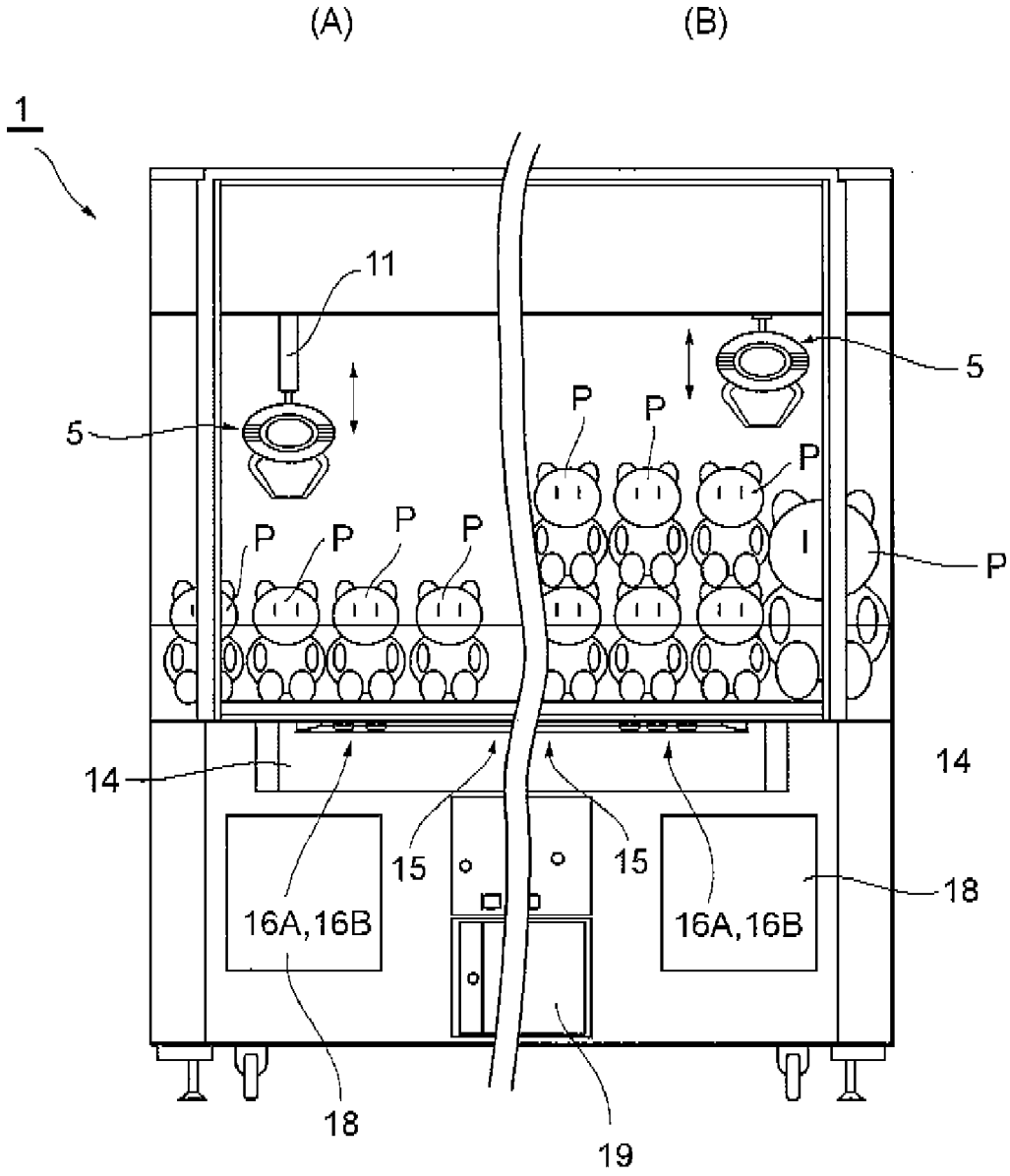
[FIG. 16] It is a front view showing the entire prize capturing game machine in the embodiment.
Figure 17:
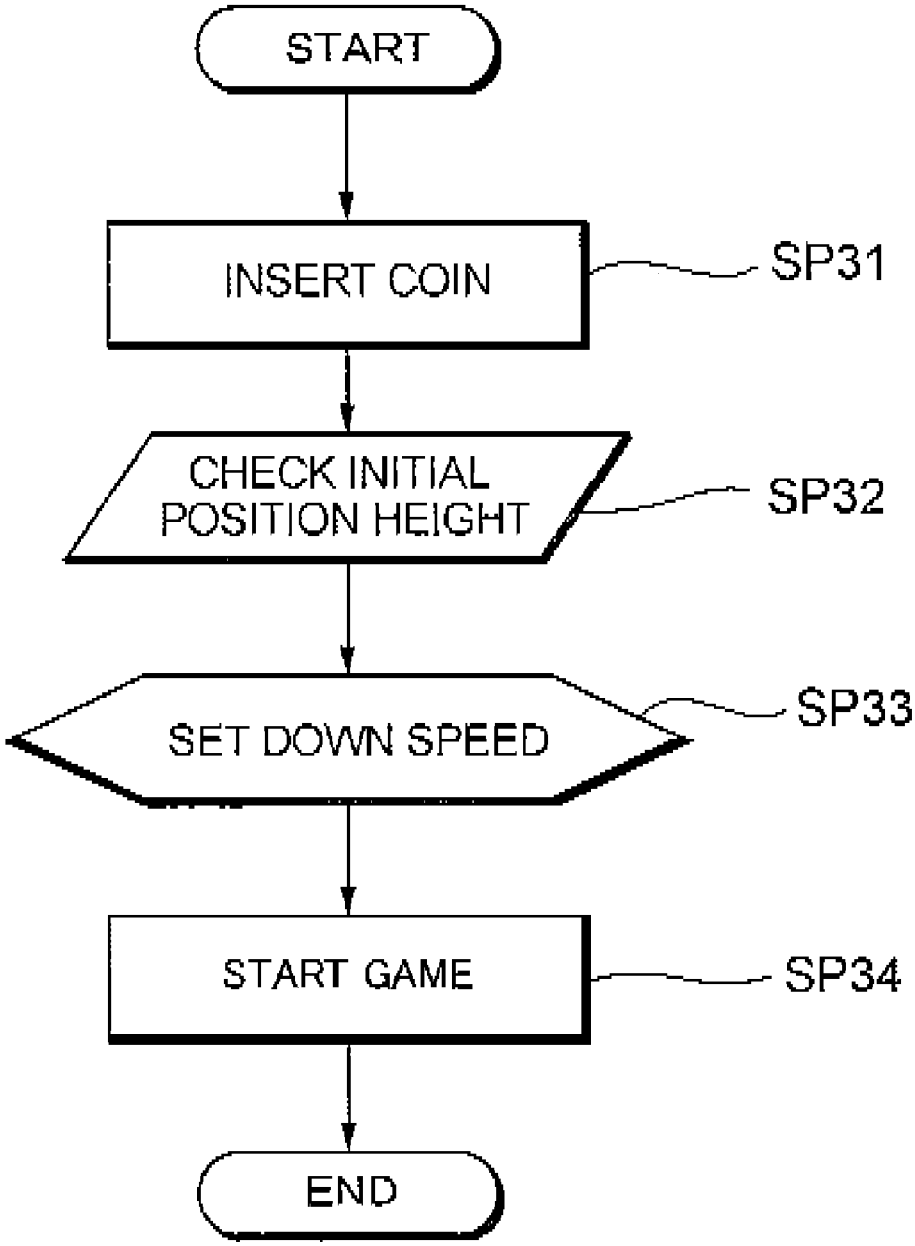
[FIG. 17] It is a flowchart showing a processing example when the up/down speed of the prize capturing section is controlled according to the initial position height of the prize capturing section.

The following describes a structure for adjusting the initial position of the prize capturing section 5, focusing on the initial position height adjusting means (see FIG. 16, etc.). The initial position height adjusting means of the embodiment makes it possible to arbitrarily set the height of the initial position as the home position of the prize capturing section 5 at the start and end of the game.

First, a brief description will be made about the advantages of making it possible to arbitrarily set the height of the initial position (home position) of the prize capturing section 5. It can be said that settings can be made according to the user's needs. In other words, for example, when prizes P are to be so piled up that they will reach the moving area of the prize capturing section 5, the initial position of the prize capturing section 5 can be set high to adapt to this situation. This also makes it possible to increase the depth (and hence the space) of placing the prizes P as capturing targets, so that the number of accommodated prizes P of even the same type can be increased. Further, prizes P larger or longer than prior and existing ones can be handled, and this also has the advantage of enhancing the diversification of prizes P and game types. Further, for example, when a placement surface 3*a* for the prizes P in the housing 3 is lowered, the initial position of the prize capturing section 5 can also be set low to adapt to this situation. In such a case, even if the position of prizes P is lowered, distance between the initial position of the prize capturing section 5 and the prizes P does not become too long, and the time required for the prize capturing section 5 to go up and down does not become too long.

Means for inputting instructions in such initial position height adjusting means is not particularly limited. As an illustrative example, an input device using a dip switch or a dial provided on the switch panel 56 can be employed. For example, in the case of the dip switch consisting of plural switches, each switch can be changed over as appropriate to instruct an initial position height uniquely defined according to the combination of switch positions. In the case of use of the dial, an initial position height corresponding to a volume value indicated on the dial can be instructed. Of cause, any input device other than the above ones can also be employed. For example, an input device using a button or a touch panel may be employed. The user (e.g., service providing side such as a game arcade or a store) can set a desired initial position height through such an input device. The set value in the input device is transmitted to the control section 30 and further stored in the memory section 31. The control section 30 instructs the initial position height adjusting means based on the set value.

The initial position height adjusting means receives an instruction signal from the control section 30 to adjust the initial position height of the prize capturing section 5. Here, the specific structure of the initial position height adjusting means is not particularly limited. For example, in the embodiment, a sensor detects that the prize capturing section 5 is in an upper end position in a liftable range so that the prize capturing section 5 will be positioned at an initial position height on the basis of the upper end position.

Thus, the sensor in the embodiment can detect that the prize capturing section 5 reaches the upper end or lower end in the liftable range of the prize capturing section 5. Specifically, as mentioned above, it is the limit switch 34 that sends out the travel limit detection signal S2 when the prize capturing section 5 reaches the travel limit position in the Z-direction liftable range. As mentioned above, the support member 11 attached to the lower side of the prize capturing base 10 in the vertical direction (Z direction) to support the prize capturing section 5 is retractable to move up and down in a predetermined stroke range. This support member 11 is, for example, of telescopic structure in which, for example, plural pipes of different diameters are combined, and it can extend and retract in a range of stoke lengths defined by the length of each pipe and the number of pipes. One end of a wire passing through the inside of this pipe is connected to the prize capturing section 5 so that this wire can be unreeled or reeled by the Z-direction moving motor 13Z arranged inside the prize capturing base 10 to extend or retract the support member 11 and hence move up or down the prize capturing section 5.

Here, the structure of the support member 11 and the like for lifting and lowering the prize capturing section 5 while supporting it will be described by taking a specific example (see FIG. 9 to FIG. 15).

The support member 11 is constituted as an expansion pipe consisting of plural pipes fitted one into another in a telescopic manner. This expansion pipe is made up by slidably fitting one of four pipes 11*a*, 11*b*, 11*c*, and 11*d* into another in a telescopic manner (see FIG. 9). A boss 35*a* of a coupler 35 is inserted into and fixed to the lower end of the lowermost pipe 11*d*. The prize capturing section 5 is connected to the tip of this coupler 35 through a bracket 36 (see FIG. 10).

Figure 11:
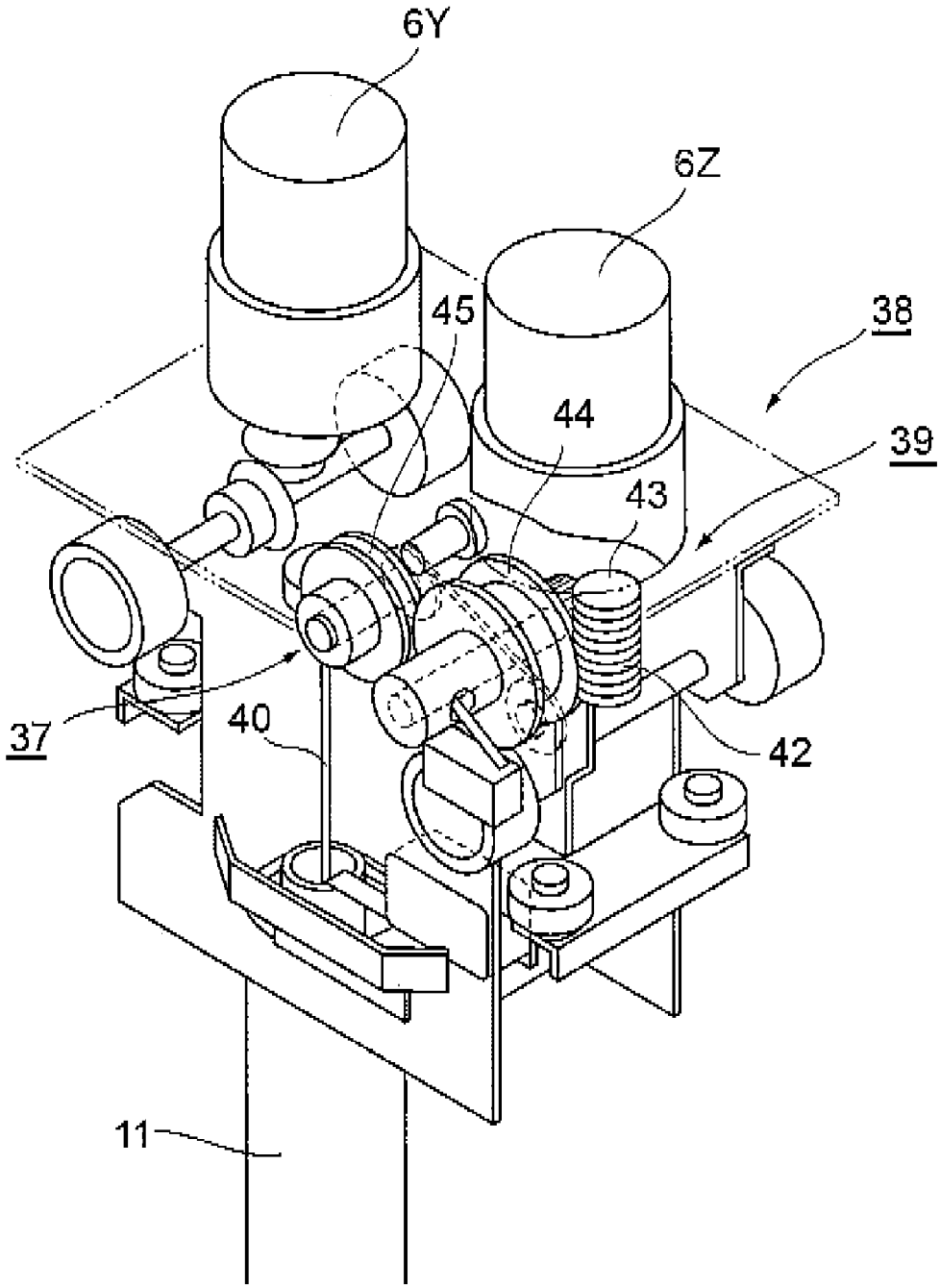
[FIG. 11] It is a perspective view showing a wire reeling/unreeling mechanism mounted on a carrier.
Figure 12:
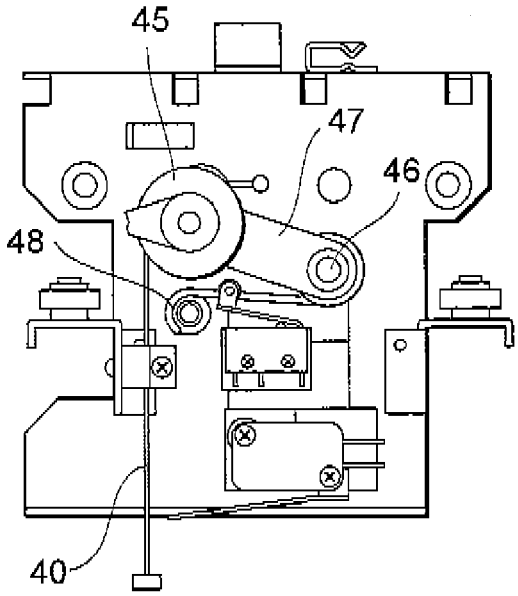
[FIG. 12] It is a front view showing a wire reeling device.
Figure 13:
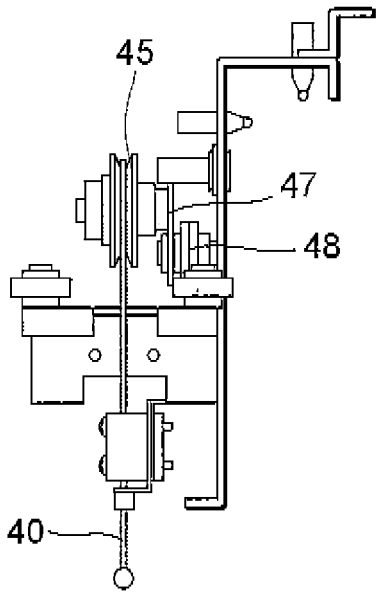
[FIG. 13] It is a side view showing the wire reeling device.
Figure 14:
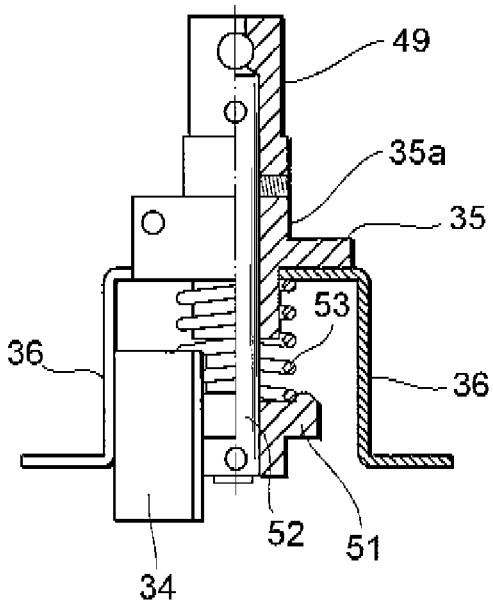
[FIG. 14] It is a longitudinal sectional view showing the structure of a limit switch, etc.
Figure 15:
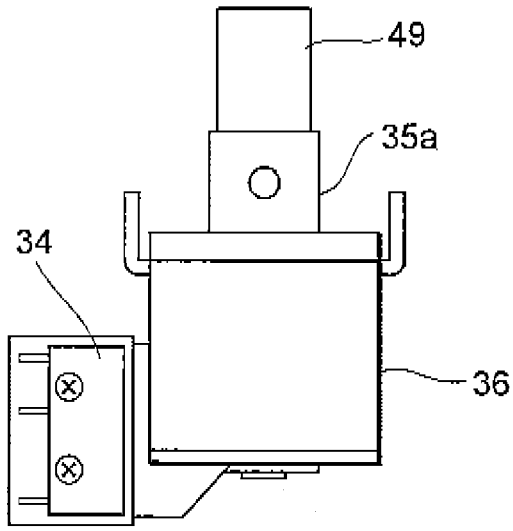
[FIG. 15] It is a side view showing the structure of the limit switch, etc.

The lifting device 37 as lifting means for moving the prize capturing section 5 up and down includes a reeling/unreeling device 39 mounted on a carrier 38, and a wire 40 reeled by this reeling/unreeling device 39, where the wire 40 passes through the inside of the support member 11 (see FIG. 11). In other words, the reeling/unreeling device 39 consists of a wire motor 41, a worm 42, a worm gear 43, a wire reel 44, and a guide reel 45. This guide reel 45 is supported by a free end of a swing arm 47 swingable about a spindle 46. The swing arm 47 is biased by a spring 48 in the clockwise direction (see FIG. 12 and FIG. 13). The wire is unreeled from the wire reel 44 and introduced into the inside of the support member 11 after being wound around the guide reel 45, and combined, at the exit end of the pipe 11*d*, with a cylindrical connector 49 capable of moving up and down in the pipe. This connector 49 has a receiving hole 49*a* at the center thereof, and an upper end of a mandrel 52 with a switch actuator 51 fixed to the lower end thereof is combined in this receiving hole 49*a*. A coils spring 53 is attached onto the switch actuator 51 in such a manner to surround the mandrel 52 (see FIG. 14 and FIG. 15). The limit switch 34 is set within a range in which the switch actuator 51 moves up and down to limit the downward movement of the wire 40. In the embodiment, the limit switch 34 is attached to a central portion of the bracket 36. This limit switch 34 is a normally-closed switch incorporated in an electrical circuit for driving the wire motor 41. In the drawings, reference numeral 54 designates a cable for feeding electric power to the motor 20.

The lifting device 37 in the embodiment is thus constructed. When the wire motor 41 is driven to unreel the wire 40 onto the wire reel 44 after the prize capturing section 5 is positioned right above a desired prize P, the support member 11 extends downward to approach the prize P. Then, when the tips of the claws 13 of the prize capturing section 5 come into contact with the prize P, the downward movement of the prize capturing section 5 stops at the time. Since the prize capturing section 5 is attached to the support member 11, it does not tilt even when it contacts the prize P. On the other hand, since the reeling/unreeling device 39 is actuated when the prize capturing section 5 contacts the prize P, the wire 40 is further unreeled inside the support member 11. As a result, the spring 53 released from the weight of the prize capturing section 5 because the prize capturing section 5 contacts the prize P expands and biases the switch actuator 51, so that the switch actuator 51 is displaced downward in FIG. 14 to actuate the limit switch 34. As a result, the rotation of the wire motor 41 is stopped to stop unreeling of the wire 40.

In other words, the above-mentioned limit switch 34 functions as a bottoming sensor. In the case of the prize capturing game machine 1 of the embodiment, when the Z direction moving motor 13Z feeds out the wire 40 sequentially, the prize capturing section 5 is moved downward by a distance corresponding to the amount of feed of the wire 40. When the prize capturing section 5 thus moved downward comes into contact with the prize P to rest thereon, or when it reaches the placement surface 3*a* for the prizes P in the housing 3, the downward movement of the prize capturing section 5 is once halted, but since the Z direction moving motor 13Z continues to feed out the wire, the tension of the wire is cancelled to temporarily relax the wire. The bottoming sensor (limit switch 34) capable of detecting this state can thus understand that the prize capturing section 5 has been moved downward up to the lower limit position. As apparent from the above description, the lower end position of the prize capturing section 5 in this specification denotes a bottoming position where the prize capturing section 5 reaches the placement surface 3*a* of the housing 3 or any of prizes P piled up thereon to stop the downward movement thereof, and the height can vary every time depending on the shapes and arrangement of the prizes P, the state of the pile, etc.

Further, another actuator and a topping sensor (another limit switch), not shown, are provided inside the prize capturing base 10. The actuator is provided in a position where, for example, it comes into contact with the upper end face of the pipe 11*d* when the support member 11 becomes the shortest state (a state where the prize capturing section 5 reaches the upper end position), so that the actuator is pushed up only when the prize capturing section 5 reaches an upper travel limit in this way. The topping sensor (limit switch) is, for example, an optical sensor for detecting whether the actuator is pushed up. The topping sensor (limit switch) detects the movement of the actuator, and this makes it possible to understand that the prize capturing section 5 goes up and reaches the upper end position.

The initial position height adjusting means mentioned above moves the prize capturing section 5 downward by a given amount on the basis of the upper end position detected by the topping sensor (limit switch) as mentioned above to locate it at the initial position height. To be more specific, the control section 30 sends a command signal to the initial position height adjusting means based on an instruction content from the input device such as the above-mentioned dip switch. Here, when the topping sensor (limit switch) detects that the prize capturing section 5 reaches the upper end position, the prize capturing section 5 is moved downward by a given amount from the position to stop the prize capturing section 5 at the initial position (home position) and place it in a standby mode.

Here, there are various methods of calculating the given amount by which the prize capturing section 5 is moved down from the upper end position. For example, a method can be adopted, which uses, as a parameter, the rotational speed of an encoder operated in response to the upward/downward movement of the prize capturing section 5. In such a case, the prize capturing section 5 can be located at the initial position height (home position) when the number of rotations of the encoder corresponding to the given amount of downward movement is counted. Alternatively, if the calculation is to be made without adding any new device such as the encoder, the given amount may be calculated by software processing. As an illustrative example, the operating time of the Z direction moving motor 13Z during the downward movement of the prize capturing section 5 from the upper end position can be counted to perform processing for stopping the action using the operating time as a parameter when the amount of feed of the wire 40 reaches a given amount. This is applicable to any existing prize capturing game machine 1 without adding any new device.

As described above, the user can set the initial position height (the height of the home position) of the prize capturing section 5 as appropriate. In addition, it is preferred to control the up/down speed of the prize capturing section 5 according to the initial position height. For example, in the embodiment, the control section 30 refers to the setting content of the initial position height in the above-mentioned initial position height adjusting means to control the operating speed (down speed) upon moving the prize capturing section 5 downward by an amount corresponding to that when the initial position height is set at a high position. In this case, a corresponding table between the initial position height and the down speed, which represents such a relationship that the down speed is fast as the initial position is high, or it is slow as the initial position is low, is prestored in the memory section 31 to determine the speed by referring to this table upon controlling the up/down speed. The following is a brief description of such a control procedure with reference to a flowchart showing only processing in the procedure (see FIG. 17). Namely, using, as a trigger, the insertion of a coin(s) (step SP31), a set value for the height of the initial position (home position) of the prize capturing section 5 is checked (step SP32). After that, the above-mentioned table is referred to set a down speed corresponding to the set value (step SP33) to start the game (step SP34). As mentioned above, changing the operating speed of the prize capturing section 5 as appropriate according to the initial position height is preferred in terms of the smooth progress of the game without extending the game too much. This is also preferred in terms of the turnover rate of the game and further the capability of adjusting the level of difficulty in playing the game. Although the case where the down speed of the prize capturing section 5 is primarily described, the same holds true for controlling the up speed.

Further, it is preferred to perform position calibration of the prize capturing section 5 whenever the prize capturing section 5 reaches the upper end position within the liftable range. During the game, since moving up and down actions are so repeated that the prize capturing section 5 is moved downward near a prize P, moved upward after opening/closing actions, moved horizontally, and returned to the set initial position at the end of the game, a deviation from the initial position height may occur in some cases. Especially such a case that the operating time of the Z-direction moving motor 13Z is used as the parameter to position the prize capturing section 5 is more likely to result in an error than the case where the number of rotations of the encoder is used as the parameter. Therefore, it is preferred to perform position calibration as appropriate. For example, in the embodiment, the control section 30 performs position calibration each time the prize capturing section 5 reaches the upper end (i.e., it rereads or renews the understanding of the reference position). This makes it possible to improve or maintain the accuracy of positioning the prize capturing section 5.

As an illustrative example, the relationship between the operating mode of the prize capturing section 5 and the timing of position calibration during the game is as follows (see FIG. 18 to FIG. 20). Note that parenthesized numbers represent a sequence of actions of the prize capturing section 5 during the game.

Figure 18:
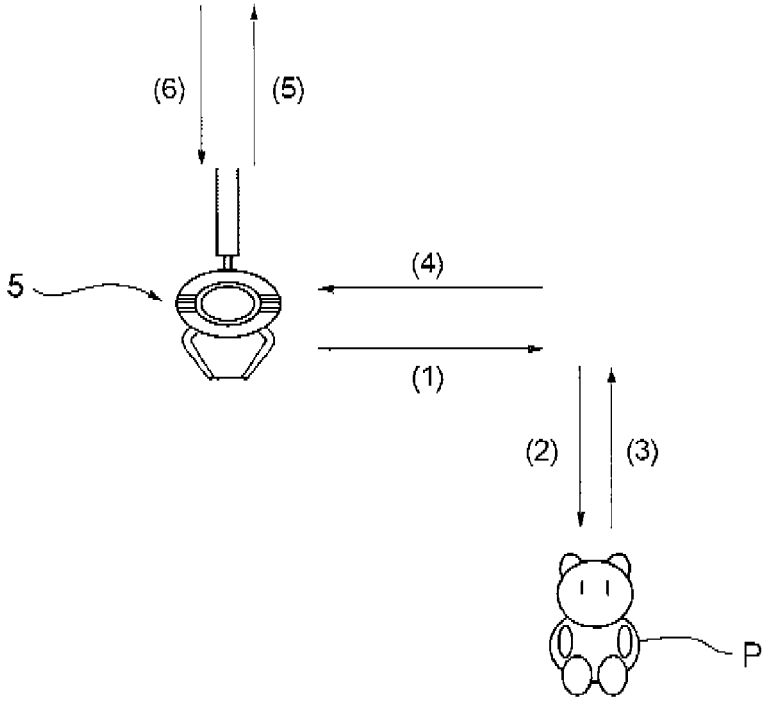
[FIG. 18] It is a sequence diagram showing a relationship between the mode of action of the prize capturing section and timing of position calibration during a game.

First, a mode of actions of the prize capturing section 5 illustrated in FIG. 18 is (1) moving horizontally from the initial position (home position) by an amount corresponding to user's operation, (2) moving downward at the position to perform opening/closing actions, (3) moving upward to the same height as the initial position, (4) moving horizontally and returning to the initial position to perform opening/closing actions once again, (5) moving upward to the upper end position within the liftable range, and (6) moving downward and returning to the initial position. Position calibration in this case can be performed in such a state that it grasps no prize P when reaching to the upper end position by the above action (5).

Figure 19:
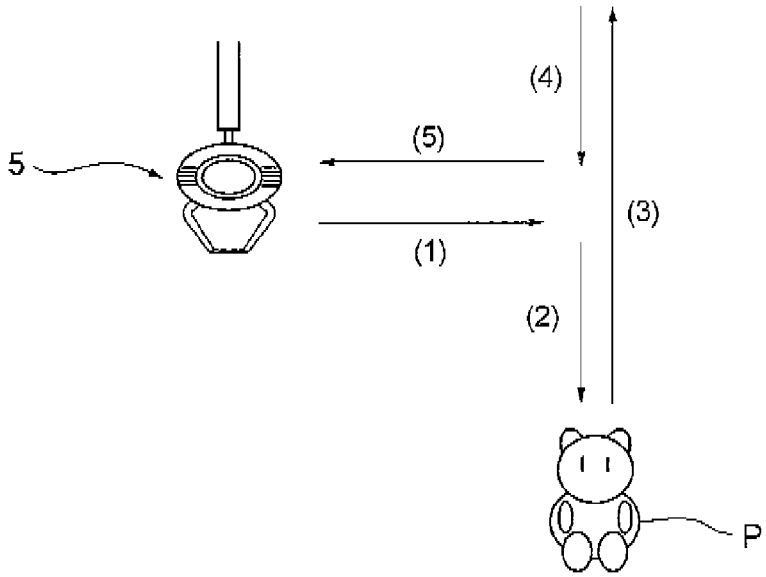
[FIG. 19] It is a sequence diagram showing another example of the relationship between the mode of action of the prize capturing section and timing of position calibration during the game.

A mode of actions of the prize capturing section 5 illustrated in FIG. 19 is (1) moving horizontally from the initial position (home position) by an amount corresponding to user's operation, (2) moving downward at the position to perform opening/closing actions, (3) moving upward to the upper end position within the liftable range, (4) moving downward to the same height as the initial position, and (4) moving horizontally and returning to the initial position to perform opening and closing actions once again. Positioning calibration in this case can be performed in such a state that it may grasp a prize P when reaching the upper end position by the above action (3).

Figure 20:
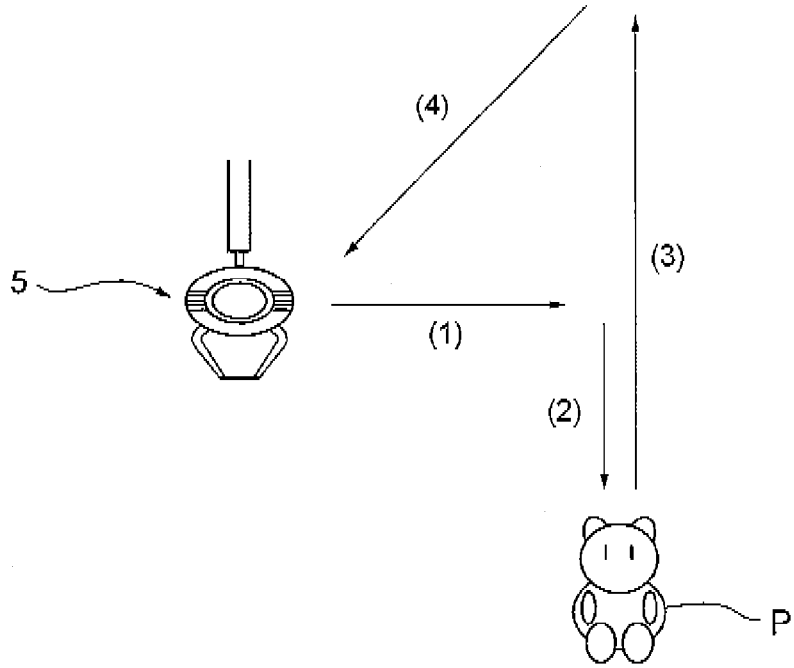
[FIG. 20] It is a sequence diagram showing still another example of the relationship between the mode of action of the prize capturing section and timing of position calibration during the game.

A mode of actions of the prize capturing section 5 illustrated in FIG. 20 is (1) moving horizontally from the initial position (home position) by an amount corresponding to user's operation, (2) moving downward at the position to perform opening and closing actions, (3) moving upward to the upper end position within the liftable range, and (4) moving horizontally while moving downward to the same height as the initial position and returning to the initial position to perform opening and closing actions once again. Positioning calibration in this case can also be performed in such a state that it may grasp a prize P when reaching the upper end position by the above action (3).

The above-mentioned modes of position calibration are just illustrative examples. For example, position calibration in FIG. 18 to FIG. 20 is all performed each time a game is played, but as another mode of position calibration, position calibration can also be performed each time power is turned on.

As described so far, in the prize capturing game machine 1 of the embodiment, the user can arbitrarily set the height of the initial position (home position) of the prize capturing section 5 using the initial position height adjusting means. Therefore, when the display of prizes P is changed on the user side, the content of display (the number of prizes P, how to stack, raising the height of the placement surface, etc.) can be flexibly changed to any of a wide range of initial position heights.

Further, the initial position height adjusting means of the embodiment uses the detection result from the topping sensor limit switch) to move the prize capturing section 5 downward from the upper end position by a given amount based on this detection result to position it at the initial position height. The topping sensor (limit switch) is also adopted in prior and existing machines, and in this case, the prize capturing section 5 can be positioned at the initial position height by software processing without the need for another component such as another sensor, and this is preferred in view of the point that an existing structure can be used intact.

(3) Structure for Moving Control Panel 14 Up and Down

Figure 21:
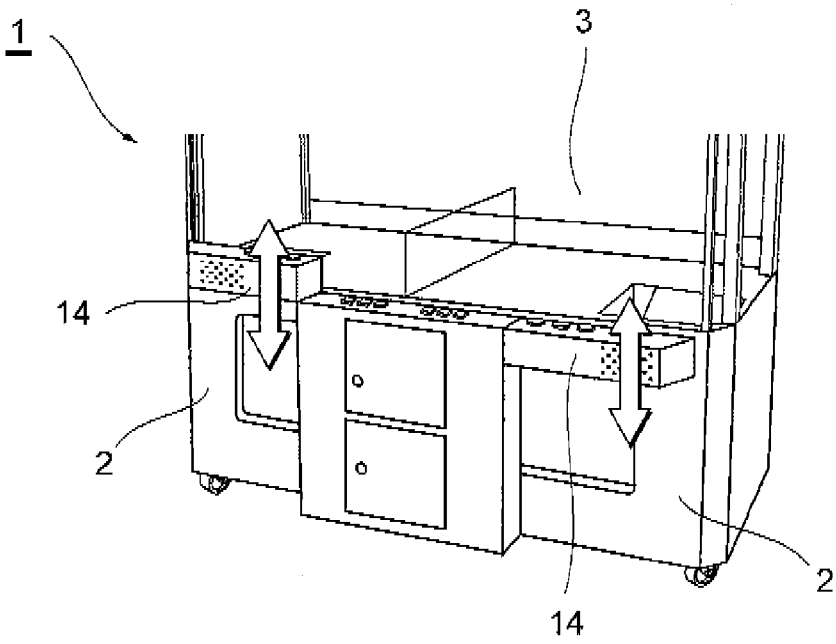
[FIG. 21] It is a schematic diagram of a prize capturing game machine in which the heights of right and left control panels can be adjusted separately.

The following describes adjustment of the height of the control panel 14 (see FIG. 21).

As mentioned above, the control panel 14 provided in the prize capturing game machine 1 includes operation switches (first and second operation buttons 16A and 16B) used when the player operates the prize capturing section 5 (see FIG. 1). In the embodiment, this control panel 14 is provided adjustably up and down with respect to the base 2 of the game machine. There are prior and existing prize capturing game machines capable of moving the control panel horizontally, for example (see Japanese Patent Application Laid-Open Nos. 2006-68218, Japanese Patent Application Laid-Open No. H11-156040, etc.), but the main concern is just to enable a player to control the game machine even if largely shifting his or her visual point during a game, rather than giving consideration to player's height. In this regard, according to the prize capturing game machine 1 of the embodiment, which moves the control panel 14 up and down to make it easy for a player short in height such as a child or a user who uses a wheelchair to control the game machine when enjoying a game (see FIG. 21 and FIG. 22). Alternatively, there is such a way to use that among plural prize capturing game machines 1 installed, the control panel 14 only for a machine focused on a younger population is set low in height, or the player may set the height.

In the above case, when the vertical position of the control panel 14 is changed, it is preferred to reset the initial position height of the prize capturing section 5. For example, when the control panel 14 is in a lower position, the initial position of the prize capturing section 5 is also set low to adapt to this situation, making it easy for even a child player or the like to see the movement of the prize capturing section 5. This is preferred in terms of easy-to-control such as horizontal movement. In other words, a new structure in which the initial position height of the prize capturing section 5 is associated with vertical adjustment of the control panel 14 can realize an easy-to-control prize capturing game machine 1 which also gives consideration to a child player or the like.

Figure 23:
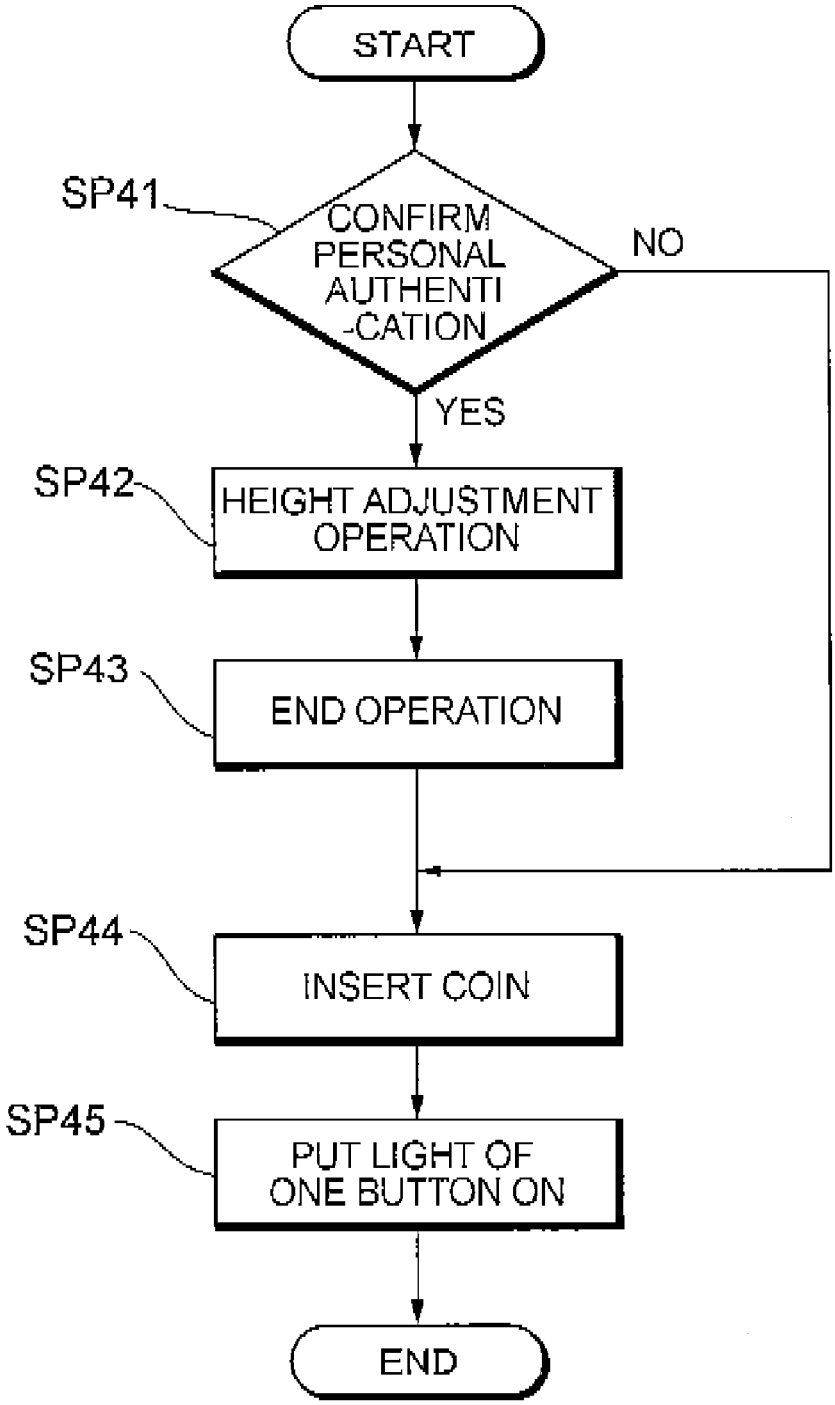
[FIG. 23] It is a flowchart showing a processing example when personal authentication is performed upon adjusting the height of the control panel.
Figure 24:
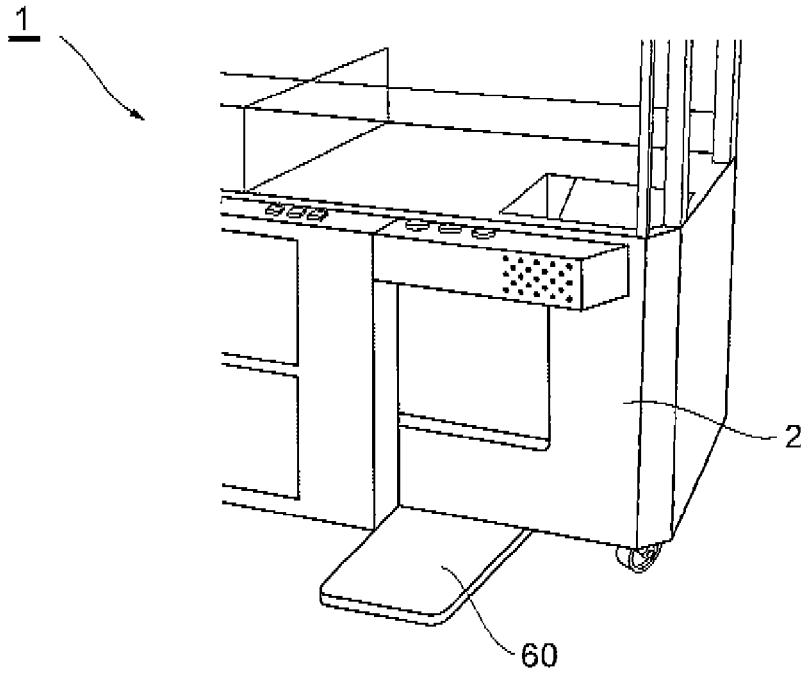
[FIG. 24] It is a diagram partially showing a prize capturing game machine with a treadle.
Figure 25:
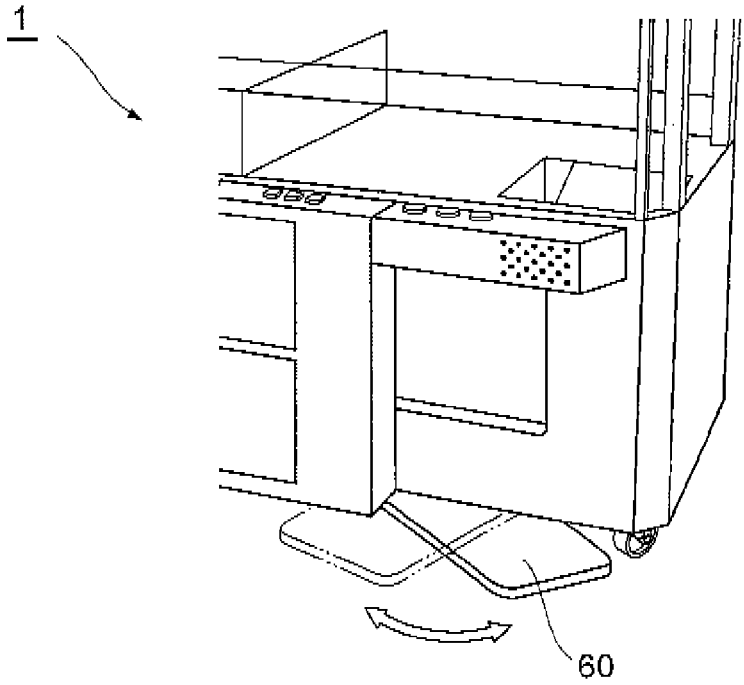
[FIG. 25] It is a diagram showing a situation where the treadle shown in FIG. 24 can rotate right and left.

Further, if the initial position height of the prize capturing section 5 is associated with the height of the control panel 14 in this way, personal authentication can be performed as well, for example (see FIG. 23). As an illustrative example, when personal authentication is confirmed (YES in step SP41), adjustment of the height of the control panel 14 is made (step SP42). Then, when a coin(s) is inserted (step SP44) after completion of the adjustment (step SP43), a button is lit (step SP45) to end a sequence of operations. When personal authentication is not confirmed (NO in step SP41), the machine waits without adjustment of the height of the control panel 14 until a coin(s) is inserted. As personal authentication performed in this case, various ways can be considered, such as to measure the height of a player using infrared and to read data using a personal card owned by the player. Further, conditions of use of the treadle 60 to be described below may be used as reference to personal authentication in order to adjust the height of the control panel 14.

Though not described in detail in this specification, the device for making the height of the control panel 14 adjustable can be constructed using a known guide roller or a drive motor. Alternatively, if a structure allowing the user to move the control panel 14 up or down manually is assumed, a stopper can be used to fix the height instead of the drive motor.

Figure 22:
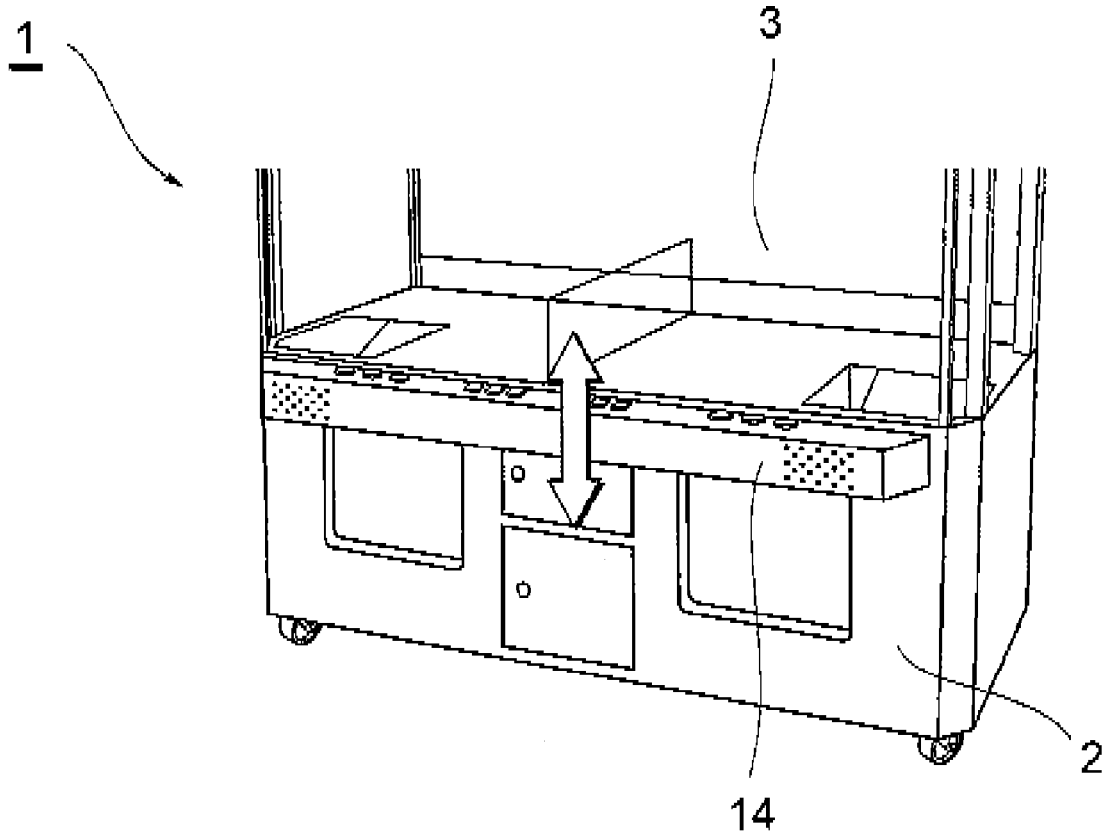
[FIG. 22] It is a schematic diagram of another prize capturing game machine in which the height of a control panel can be adjusted integrally.

Upon moving the control panel 14 up and down, the entire control panel 14 in the prize capturing game machine 1 may be moved up and down integrally (see FIG. 22). Alternatively, it is also preferred to making control panels 14 on the right and left sides (designed for a first player and a second player to play a game at the same time) adjustable separately (see FIG. 21).

(4) Structure of Treadle 60

Provided also in the prize capturing game machine 1 of the embodiment is a treadle 60 accommodated in the base 2 and on which a player can step (see FIG. 24 to FIG. 28). If the vertical position of the control panel 14 is adjustable as mentioned above, it is easy to control and convenient for even a child player or the like. In the embodiment, the treadle 60 in the base 2 is also used as necessary, making it possible to play a game in such a state that a player steps thereon. In this case, the player enjoys the game in an easy-to-see and easy-to-control manner.

Figure 26:
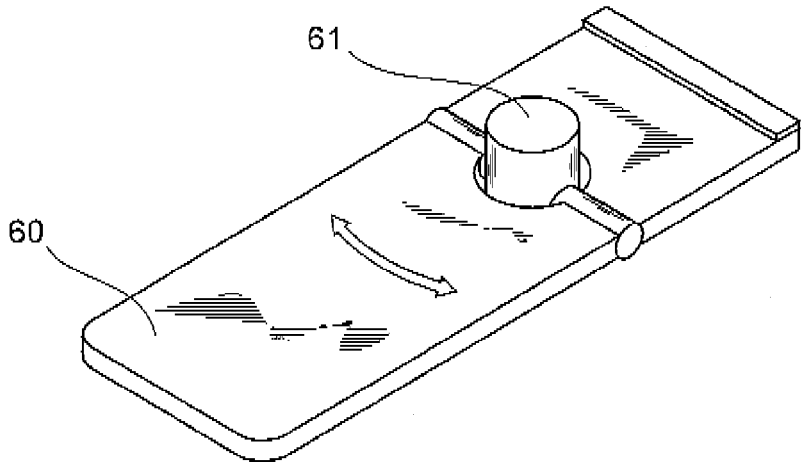
[FIG. 26] It is a diagram showing the treadle and a fulcrum as the center of rotation.

Further, in the embodiment, this treadle 60 is rotatable to right or left about a fulcrum 61 (see FIG. 26). For example, there is an operating problem that a player may stumble and tumble when a board is just placed. On the other hand, in the case of the prize capturing game machine 1 of the embodiment, which is provided with the treadle 60 rotatable about the fulcrum 61 and accommodated in a lower portion of the base 2, even if player's leg strikes it, since the treadle 60 can rotate to right or left to escape therefrom, so that the player can avoid stumbling as much as possible. For example, it is also preferred to provide a cushion for cushioning the impacts on the edges of the treadle 60.

Figure 27:
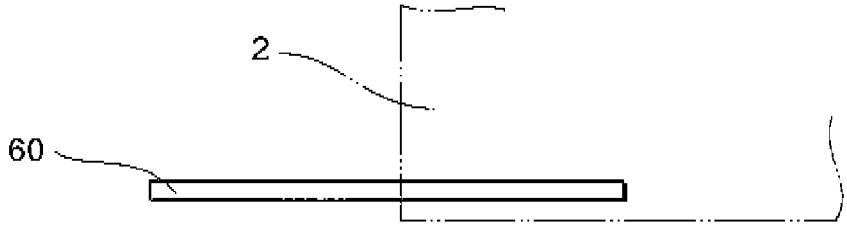
[FIG. 27] It is a schematic diagram showing the treadle at a horizontal position.
Figure 28:
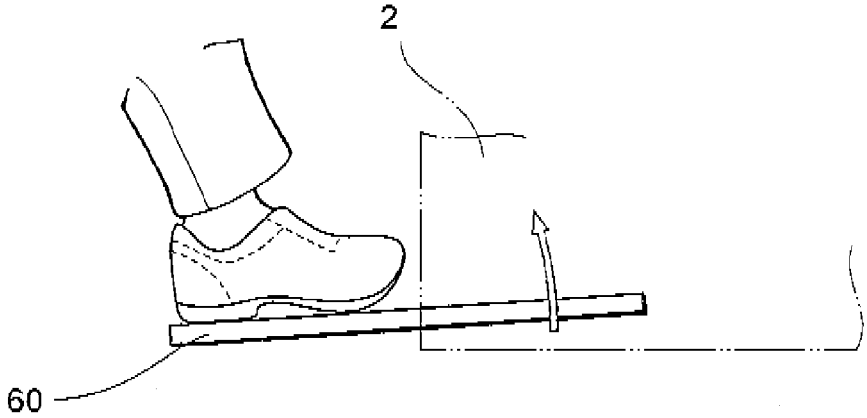
[FIG. 28] It is a schematic diagram showing the treadle inclined by a foot of a player stepping thereon.

Further, in the embodiment, this treadle 60 is normally horizontal but is tilted by a given amount when the player steps thereon, making it difficult for the treadle 60 to rotate (see FIG. 27 and FIG. 28). This can eliminate the danger of unexpectedly rotating during use of the treadle 60, making it possible to sufficiently perform the functions as the treadle 60.

It is preferred to also provide detection means such as an optical sensor for detecting that this treadle 60 comes out of the base 2 and is in a usable state. If the treadle 60 is in the usable state, a user-friendly structure can be realized, such as to automatically adjust the position of the above-mentioned control panel (constructed to going up and down by the drive motor) 14 to become low, or to work together so that the initial position height of the prize capturing section 5 becomes low for increased visibility.

Figure 29:
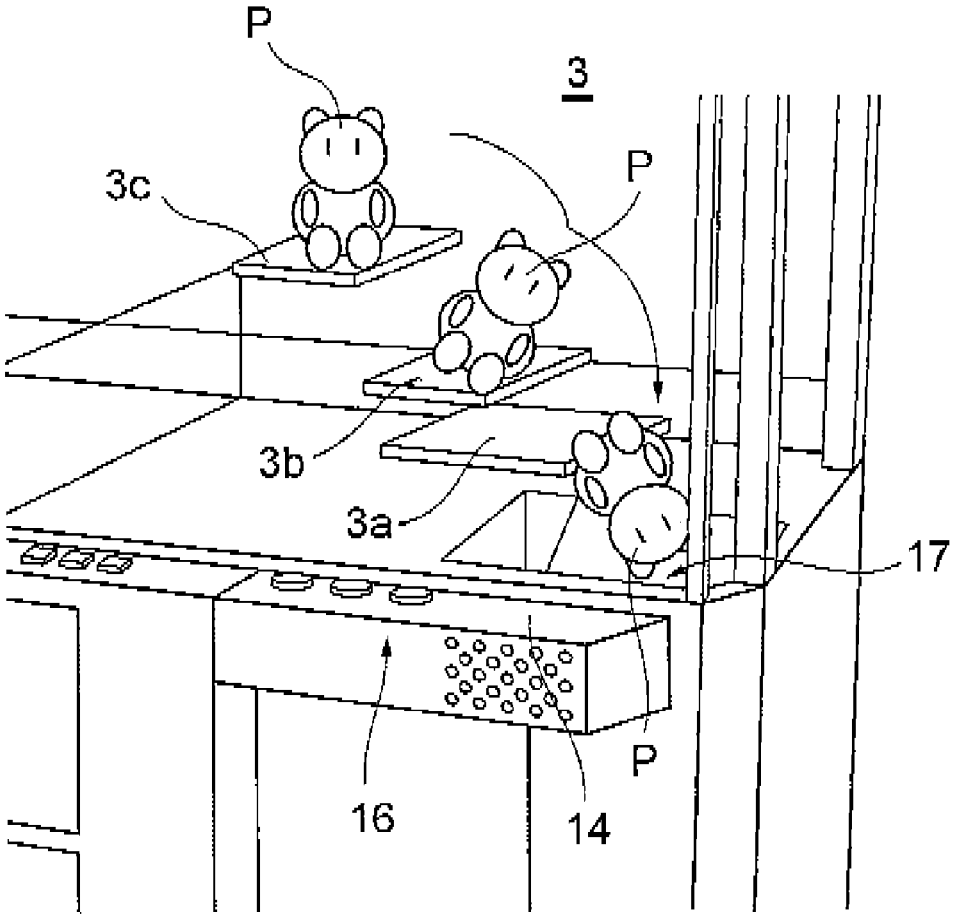
[FIG. 29] It is a schematic diagram of a prize capturing game machine in which plural steps are provided in a housing section.

In the embodiment described so far, it is assumed that the placement surface 3*a* in the housing 3 is horizontal in principle, but the present invention is suitably applied to a case where the housing 3 is constructed to have plural steps 3*b* and 3*c* as shown in FIG. 29. In other words, the housing 3 should allow for enough height to provide the plural steps 3*b* and 3*c*. The prize capturing game machine 1 of the embodiment, which can arbitrarily set any initial position height of the prize capturing section 5 as mentioned above, can flexibly respond to such a structure. In such a case, so-called business operations using space is possible, having the advantage of provide wide range of ways to play and ways to show.

(5) Structure for Performing Action to Further Push Prize

The following describes a structure for performing an action to further push in the prize P (see FIG. 30 to FIG. 34).

In the prize capturing game machine 1 according to the embodiment, upon using the lifting device 37 to move the prize capturing section 5 downward, a time lag is inserted between the time when the limit switch 34 detects that the prize capturing section 5 is bottomed out and the time when the lifting device 37 goes into the subsequent operation. In such a case, the lifting device 37 is not stopped immediately after the detection that the prize capturing section 5 is bottomed out, so that a load can be exerted for a longer time on a prize P hooked, for example, on the prize drop hole 17*a*. In addition, since there is a time difference between the time when the prize capturing section 5 is bottomed out and the time when the action of moving downward by the lifting device 37 is stopped, the prize capturing section 5 hung by the support member 11 or the wire 40 is opened during the time lag, enough self-weight can act on the prize P. When the lifting device 37 is stopped immediately after the prize capturing section 5 is bottomed out like the prior or existing ones, there is the upper limit without sufficiently exerting the entire weight (self-weight) of the prize capturing section as a load on the prize P, but according to the embodiment, a load that exceeds this upper limit can be exerted for a fixed time. Therefore, the layout of a prize P hooked on the prize drop hole 17*a* is available as well as the normal lifting action and grasping action (see FIG. 31 and FIG. 32), and this makes it possible to perform operations corresponding to diversified displays.

Figure 30:
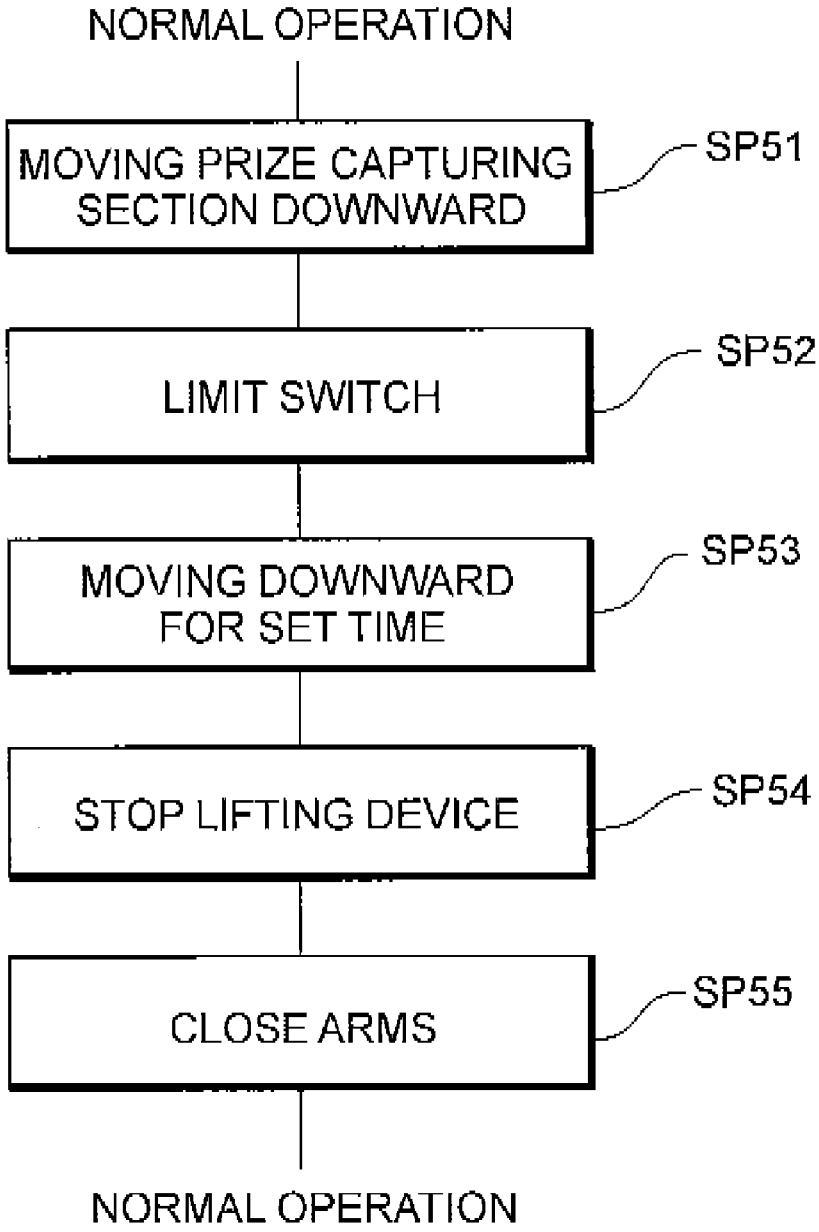
[FIG. 30] It is a flowchart showing an example of procedure to be added to the normal operation in order to perform a prize push-in action.
Figure 31:
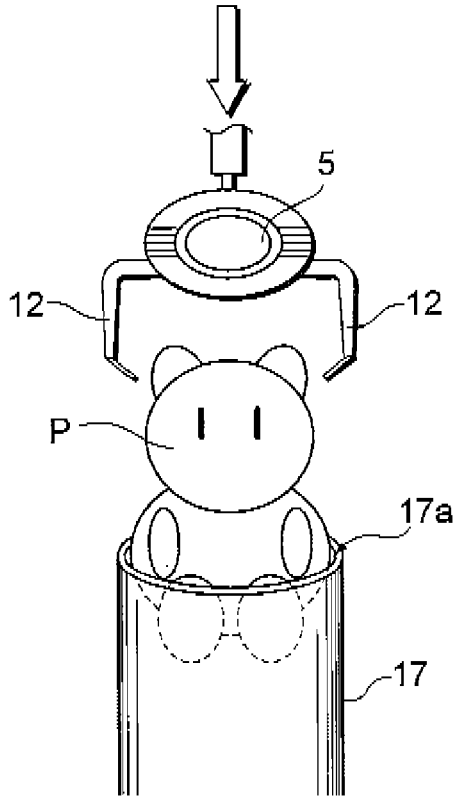
[FIG. 31] It is a diagram showing a prize hooked on a prize drop hole and the prize capturing section being moved downward toward the prize.
Figure 32:
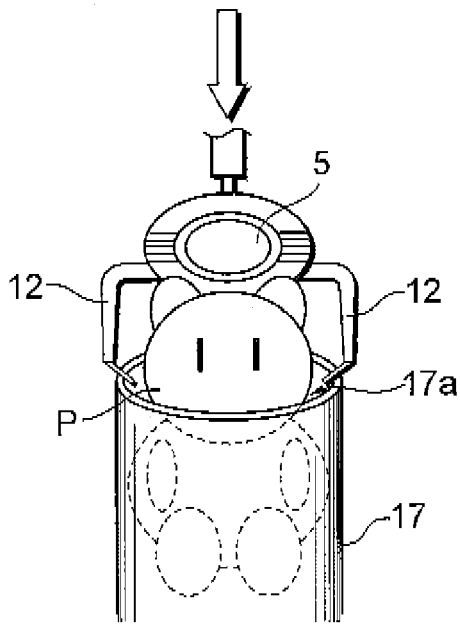
[FIG. 32] It is a diagram showing a state of pushing in the prize shown in FIG. 31.

Such a push-in action can be performed by adding the following procedure to the normal actions (lifting/lowering action and grasping action of the prize capturing section 5 in the prior and existing prize capturing game machines) (see FIG. 30). In other words, in the normal operation, the prize capturing section 5 is moved downward (step SP51), and if the limit switch 34 detects that the prize capturing section 5 is bottomed out (step SP52), the lifting device 37 is immediately stopped in the normal operation, but in the embodiment, a time lag is introduced to insert a delay until this lifting device 37 is stopped. In such a case, the lowering action by the lifting device 37 is continued only for a set period from when the limit switch 34 detects the bottomed state (step SP52) until the lifting device 37 is stopped (step SP54). In the case of the embodiment, since the feed action of the wire 40 is continued (step SP53), a load having a value that exceeds the prior and existing load can be exerted on the prize P. When the lifting device 37 is stopped (step SP54) after the set period (time lag) has elapsed, the arms 12 are closed (step SP55). After that, the same actions as those in the normal operation have only to be performed.

As mentioned above, the placement surface 3*a* of the housing 3 or the bottoming position for striking a prize(s) P piled up on the placement surface 3*a* to stop the lowering action is described as the lower end position of the prize capturing section 5 in this specification. The bottoming state mentioned above means a state where the prize capturing section 5 reaches the bottom position to stop the lowering action temporarily or constantly.

During the time lag, the operation of the lifting device 37 may be continued, or the operation of the lifting device 37 may be continued and stopped at certain timing during the time lag. The next action of the lifting device 37 that follows continuation of the operation of the lifting device 37 is the lowering/stopping action, while the next action of the lifting device 37 in the case where the operation is stopped at certain timing during the time lag is to start lifting. Thus, the next action of the lifting device 37 is not particularly limited to one action. Basically, the lowering action may be either continued or stopped during the time lag as long as enough load can be exerted on the prize P, and this changes the next action of the lifting device 37.

Further, it is preferred to insert the time lag after becoming the bottoming state as mentioned above only when the prize capturing section 5 is located within a certain range (push-in area). In such a case, the push-in action can performed only within a range intended to correspond to the diversified displays. For example, in the embodiment, the time lag is inserted when at least part of the prize capturing section 5 is located above the prize drop hole 17*a*, i.e., only when it is located within a range capable of pushing in the prize P hooked on the prize drop hole 17*a*, and the normal operation is performed in a range (so-called normal field) where such a push-in action is unnecessary.

The position of the prize capturing section 5 in an ICY plane can be calculated from the X coordinate and the Y coordinate to determine whether the prize capturing section 5 is located within the certain range. In other words, a range that matches the prize drop hole 17*a* or a wider range including the prize drop hole 17*a* may be preset as the push-in area, and the time lag is inserted to perform the push-in action only when the prize capturing section 5 is in the set range (push-in area). Further, though not particularly shown, if a mechanism for changing the opening width of the prize drop hole 17*a* (for example, a mechanism such as a slider that is slidable in the X direction and capable of changing the size of the prize drop hole 17*a* in the X direction) is provided, the set range (push-in area) has only to be changed according to the opening width of the prize drop hole 17*a*. Thus, the mechanism that allows the user side to freely set the opening width of the prize drop hole 17*a* is convenient for displaying a big prize P, for example. For example, it is convenient if a sensor for detecting the position of the above-mentioned slider is provided to change the set range according to the position of the slider (the change in the X coordinate). The same holds true for a case where an encoder is used to calculate the X coordinate and the Y coordinate of the prize operating section 5. In this case, a distance traveled by the prize operating section 5 from the initial position is measured as the number of pulses obtained from the number of rotations of the encoder, and the number of pulses is compared with a preset number of pulses. Like the setting of the above-mentioned initial position height, a set value for the number of pulses to be set can be, of cause, changed by the user using the input device. The set value can be transmitted to the control section 30 and stored in the memory section 31.

Further, when the time lag is introduced to insert a delay between detection of the above-mentioned bottoming state and the next action of the lifting device 37, means for measuring or detecting timing of transition to the next action is not particularly limited, and various means can be adopted. As an illustrative example, the duration of driving the wire motor 41 in the lifting device 37 may be measured to stop the lifting device 37 (wire motor 41) when a certain period has elapsed, or the number of rotations of the encoder that rotates in response to the wire motor 41 or a pulley (not shown) may be detected to stop the lifting device 37 when the amount of feed of the wire 40 reaches a given value. Alternatively, the load is used as a parameter, and when the load acting on the prize P exceeds a fixed value, or when the hanging load of the prize capturing section 5 and the support member 11 becomes smaller than a fixed value, the lifting device 37 may be stopped. Of course, there is no problem if the time is measured using the timer of the control section 30. Though not particularly shown, a device for performing control mentioned above can be, for example, a mechanical pressure sensor, an optical pressure sensor, or a gravimetric sensor using load cells and the like.

The above is to measure or detect timing of transition to the next action of the lifting device 37 using time, load, distance (rotational speed), etc. as parameters. Alternatively, detection timing delay means 64 can be provided to delay detection timing of the limit switch 34 itself in order to insert the time lag. As an illustrative example, the detection timing delay means 64 can be constructed by a mechanical mechanism provided with a slider for changing the relative position of the limit switch 34 to change the detection timing. To be more specific, a slider 63 is provided to be movable a predetermined distance along, for example, a long hole 62 to change the relative position of the limit switch in response to the movement of the slider 63, resulting in a delay in timing of bottoming detection by the limit switch 34 (see FIG. 34). Thus, such a structure to physically change the relative position of the limit switch 34 can delay the detection timing without software control. The guide reel 45 shown in the drawings can travel a predetermined distance and is biased by biasing means, not shown, (in the upward direction in FIG. 34), and when the prize capturing section 5 is bottomed out and the tension of the wire 40 is weakened, the guide reel 45 moves upward to change the routing of the wire 40 upward (see FIG. 34).

Shown here is just an illustrative example of the structure of the detection timing delay means 64, and the detection timing by the limit switch 34 may be delayed in any other way, such as to change the relative position of the switch actuator. Alternatively, though not particularly shown, the tension of the wire 40 is made changeable by a dial, and the tension of the wire 40 is so changed that the detection timing by the limit switch 34 can be delayed. Further, in addition to the structure in which the detection timing delay means 64 is constructed mechanically as mentioned above, the detection timing by the limit switch 34 may also be delayed by software processing such as to preset delay time according to an operating program for the control section 30. According to the various control means described so far, the detection timing can be delayed as appropriate to control the load acting on the prize P.

Figure 33:
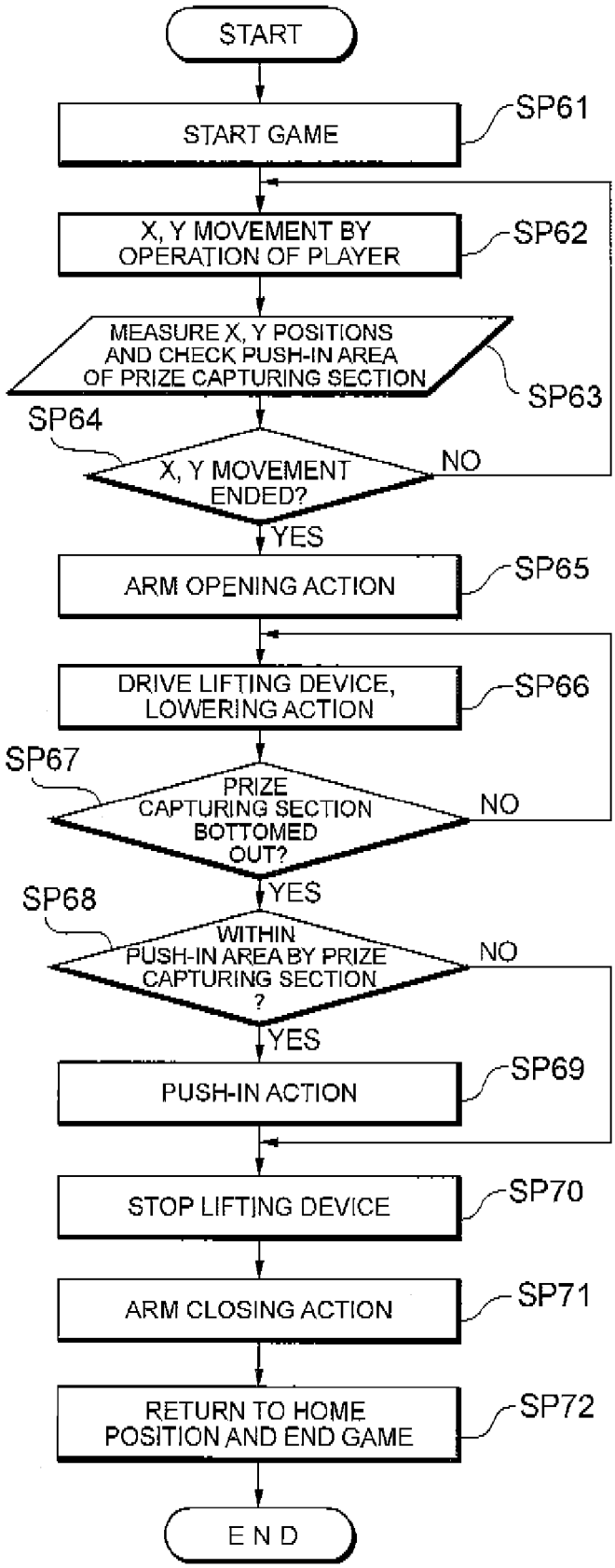
[FIG. 33] It is a flowchart showing a specific example of a processing content during the prize push-in action.
Figure 34:
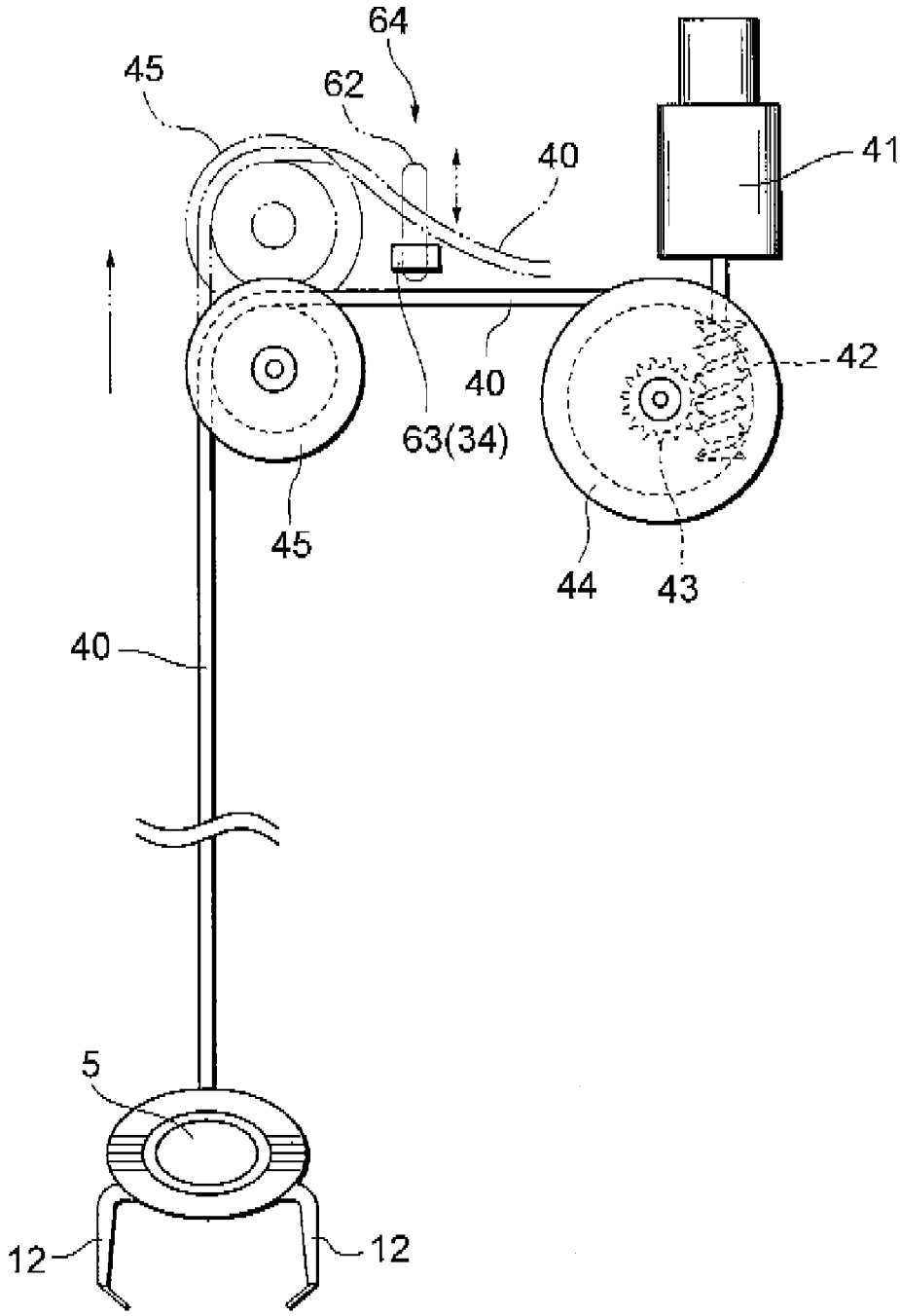
[FIG. 34] It is a schematic diagram showing an example of the structure of a detection timing delay means.

Subsequently, a processing content upon push-in action will be specifically described with reference to a flowchart showing an example of the push-in action by the prize capturing section 5 (see FIG. 33).

First, after the start of a game (step SP61), when a player operates the first operation switch 16A and the second operation switch 16B in the operating section 16, the prize capturing section 5 is moved in the X direction and the Y direction according to the operations (step SP62). After the prize capturing section 5 is moved in this manner, the X coordinate and the Y coordinate are measured to measure the position of the prize capturing section 5 in an X-Y plane in order to check if the coordinate position of the prize capturing section 5 is in the push-in area (step SP63). Next, it is determined whether movement in the X direction and the Y direction is ended (step SP64). If not ended, processing returns to step SP62 to continue to move the prize capturing section 5 in the X direction and the Y direction based on the layer operation (NO in step SP64).

If the movement in the X direction and the Y direction is ended in step SP64 (YES in step SP64), then the action of opening the arms 12 is performed (step SP65). Further, the lifting device 37 is driven to perform the lowing action of the prize capturing section 5 (step SP66). During moving the prize capturing section 5 downward, it is determined whether the prize capturing section 5 is bottomed out, i.e., whether the limit switch (bottoming sensor) 34 detects that the prize capturing section 5 reaches the lower travel limit (step SP67). The lowering action is continued as long as it is bottomed out (NO in step SP67).

If it is detected that the prize capturing section 5 is bottomed out (YES in step SP67), it is then determined whether the prize capturing section 5 is located within the range of the above-mentioned push-in area (step SP68). If it is within the range of the push-in area (YES in step SP68), the push-in action by the prize capturing section 5 is performed (step SP69), and after the set period has elapsed, the operation of the lifting device 37 is stopped (step SP70). On the other hand, if the prize capturing section 5 is not in the range of the push-in area (NO in step SP68), the operation of the lifting device 37 is stopped immediately or without delay without the push-in action (step SP70).

When the action of the lifting device 37 is stopped (step SP70), the arm opening action is performed (step SP71), the prize capturing section 5 is moved upward and returned to the home position, and the game is ended (step SP72).

Although the specific example of the detection timing delay means 64 capable of arbitrarily executed on the service providing side such as the user is primarily described so far, it is also preferred to enable an operation for the player to select whether to perform the push-in action by the prize capturing section 5. For example, a push-in instruction switch 16C for changing over between a state without time lag and a state with the time lag during an interval from the time when the limit switch 34 detects that the prize capturing section 5 is bottomed out to the time of transition of the lifting device 37 to the next action is provided together in the operating part 16 (first operation switch 16A and second operation switch 16B) on the control panel 14, for example, in such a manner to be operable by the player (see FIG. 1). For example, when this push-in instruction switch 16C is off, even if the prize capturing section 5 is located within the push-in area, processing not to go through the push-in action step (step SP69) in the above-mentioned flowchart can be performed to realize the operation as instructed by the player not to perform the push-in action. According to such a prize capturing game machine 1, the player can operate the push-in instruction switch 16C to instruct whether to perform the action of pushing in the prize P during upward/downward movement of the prize capturing section 5, enabling a prize capturing game with more improved interest and attraction.

As described above so far, in the prize capturing game machine 1 of the embodiment, the push-in action of the prize P is performed as necessary during the lowering action of the prize capturing section 5, so that a load can be exerted on a prize P hooked, for example, on the prize drop hole 17*a* for a fixed time. Thus, according to this prize capturing game machine 1, a load that exceeds the prior and existing upper limit can be exerted on the prize P, and the load that exceeds the upper limit can be exerted for a fixed time, so that a push-in load useful to drop down and capture the prize P hooked on the prize drop hole 17*a* can be applied. Under the circumstances that such a layout is becoming common along with the diversification of display patterns, a highly interesting and attractive game can be provided in consideration of the mental state on the side of player playing the game.

(6) Another Structure for Performing Action to Further Push Prize

The following describes another structure for performing an action to further push in the prize P as another embodiment (see FIG. 35 to FIG. 41). In particular, a description will be made below mainly about a structure for detecting the topping state and bottoming state of the prize capturing section 5.

Figure 35:
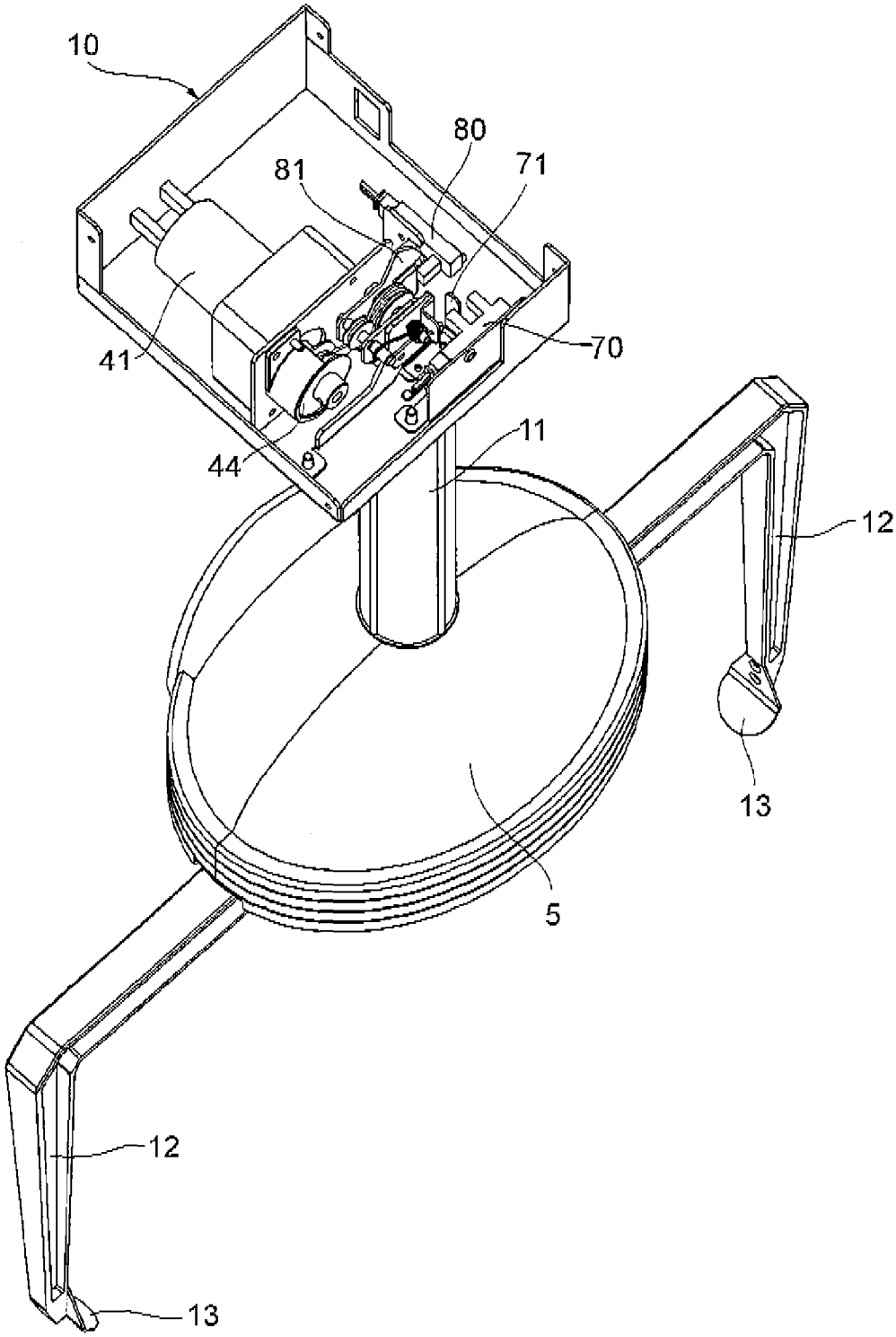
[FIG. 35] It is a perspective view of a prize capturing section and a prize capturing base, showing another structure for performing the prize push-in action according to another embodiment of the present invention.
Figure 36:
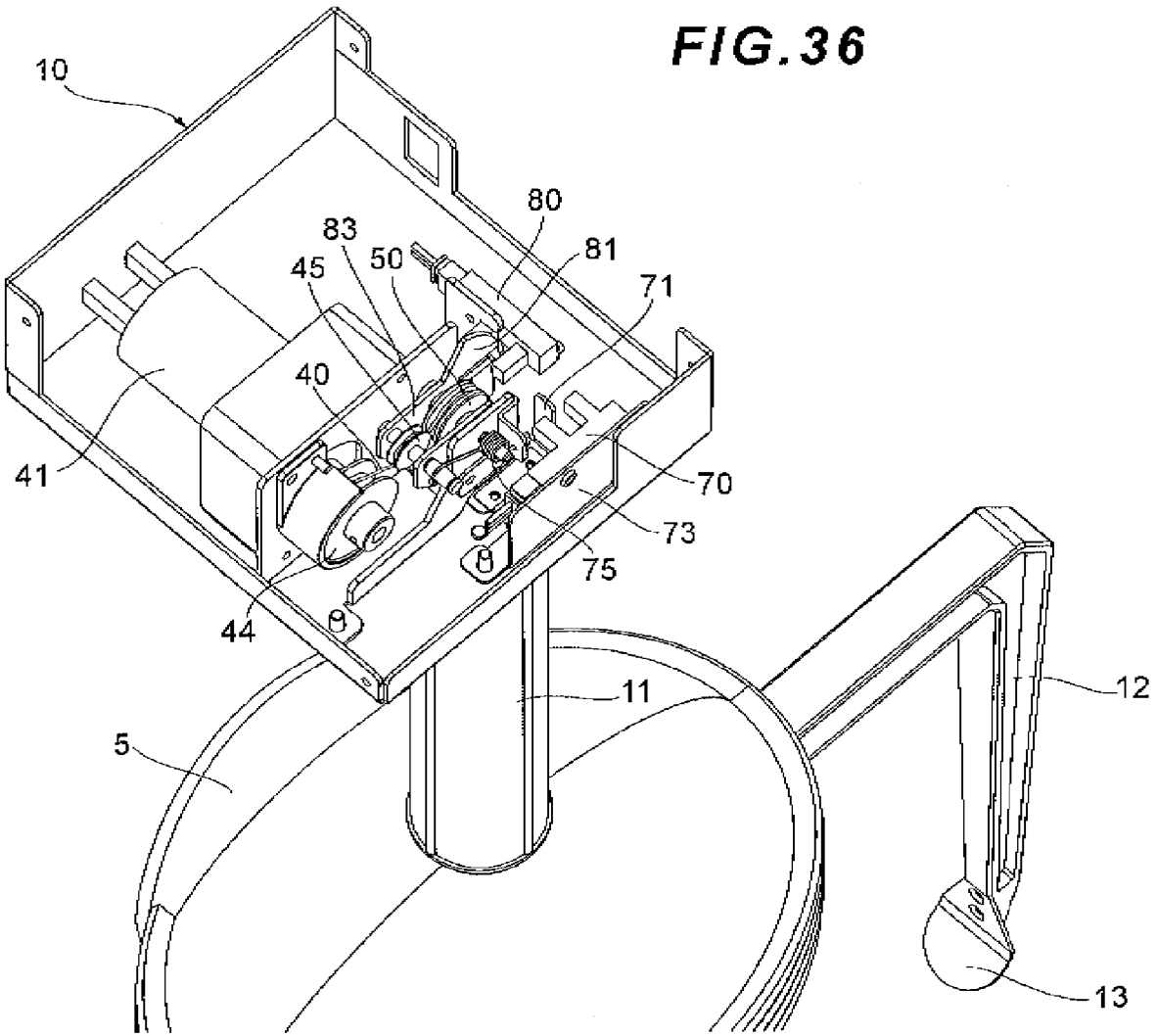
[FIG. 36] It is an enlarged view showing in detail an internal structure of the prize capturing base shown in FIG. 35.
Figure 37:
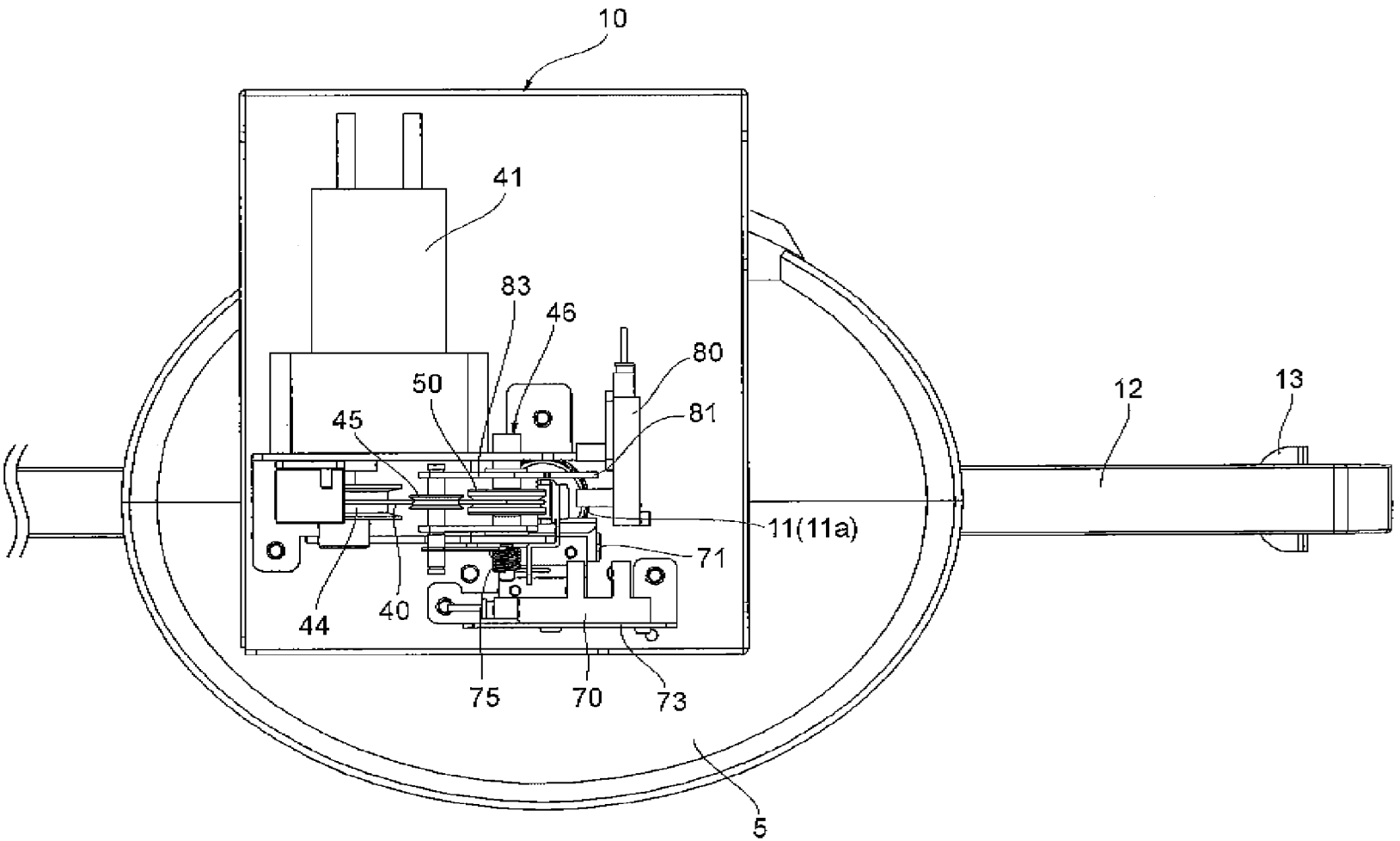
[FIG. 37] It is a plan view of the prize capturing base shown in FIG. 35.
Figure 38:
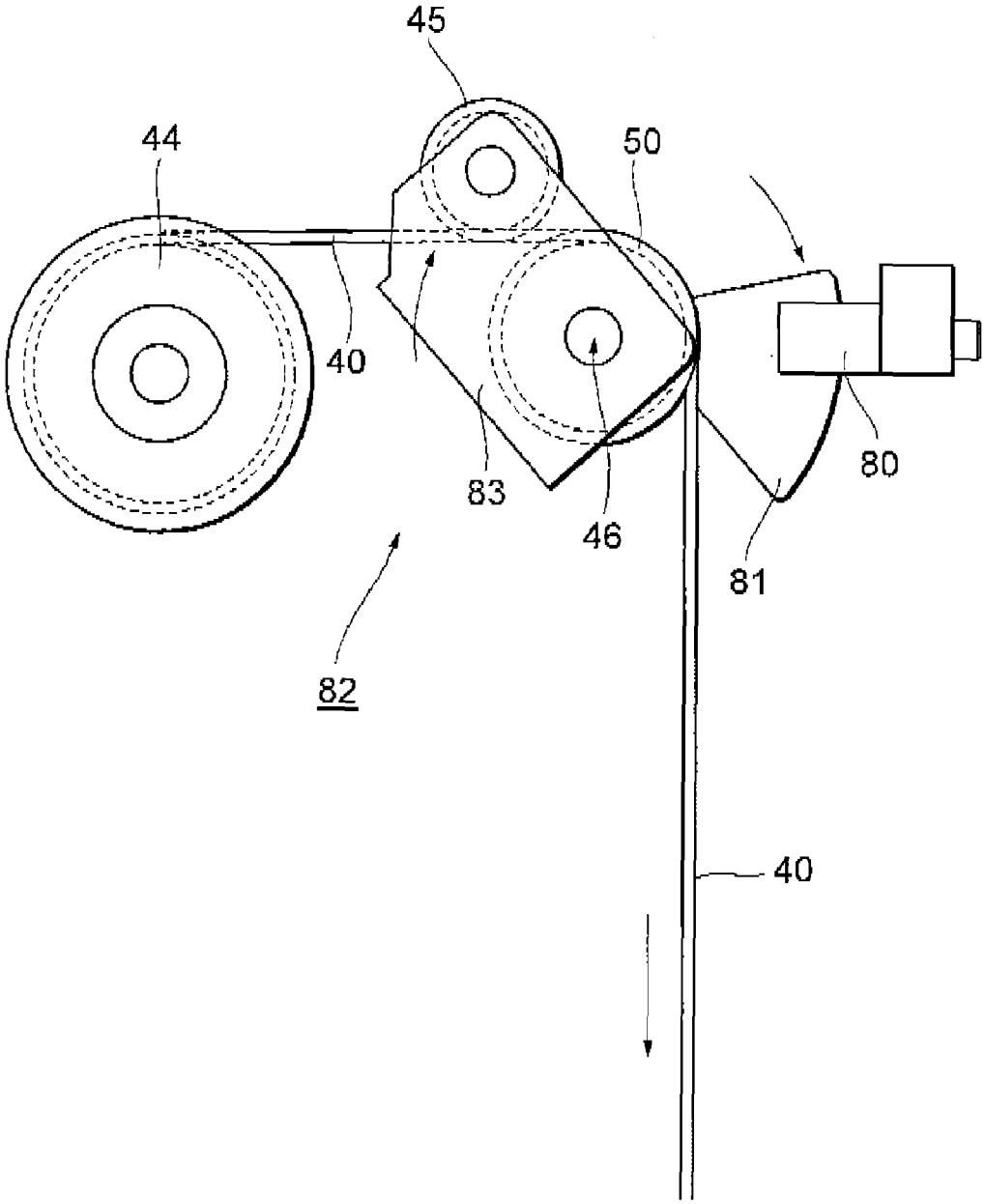
[FIG. 38] It is a diagram showing the state of a bottoming sensor and the vicinity at the normal time.

In the prize capturing section 5 shown in FIG. 35, the topping state and the bottoming state of the prize capturing section 5 is detected by a topping sensor 70 and a bottoming sensor 80 as optical sensors each including a light-emitting element and a light-receiving element, respectively. The topping sensor 70 and the bottoming sensor 80 are both incorporated in the prize capturing base 10 (see FIG. 35 and FIG. 36).

The topping sensor 70 is a device for detecting that the prize capturing section 5 is located at the upper position in a range capable of lifting and lowering, configured to send out the travel limit detection signal S2 when the prize capturing section 5 reaches the upward travel limit position in the range capable of lifting and lowering in the Z direction. Although specific means for detecting that the prize capturing section 5 reaches the upward travel limit position is not particularly limited, the position of the upper end (to be more specific, the upper end of the uppermost pipe 11*a*) of the support member 11 is detected in this embodiment to detect that the prize capturing section 5 reaches the upward travel limit position (i.e., it becomes the topping state) (see FIG. 40 and FIG. 41).

Figure 40:
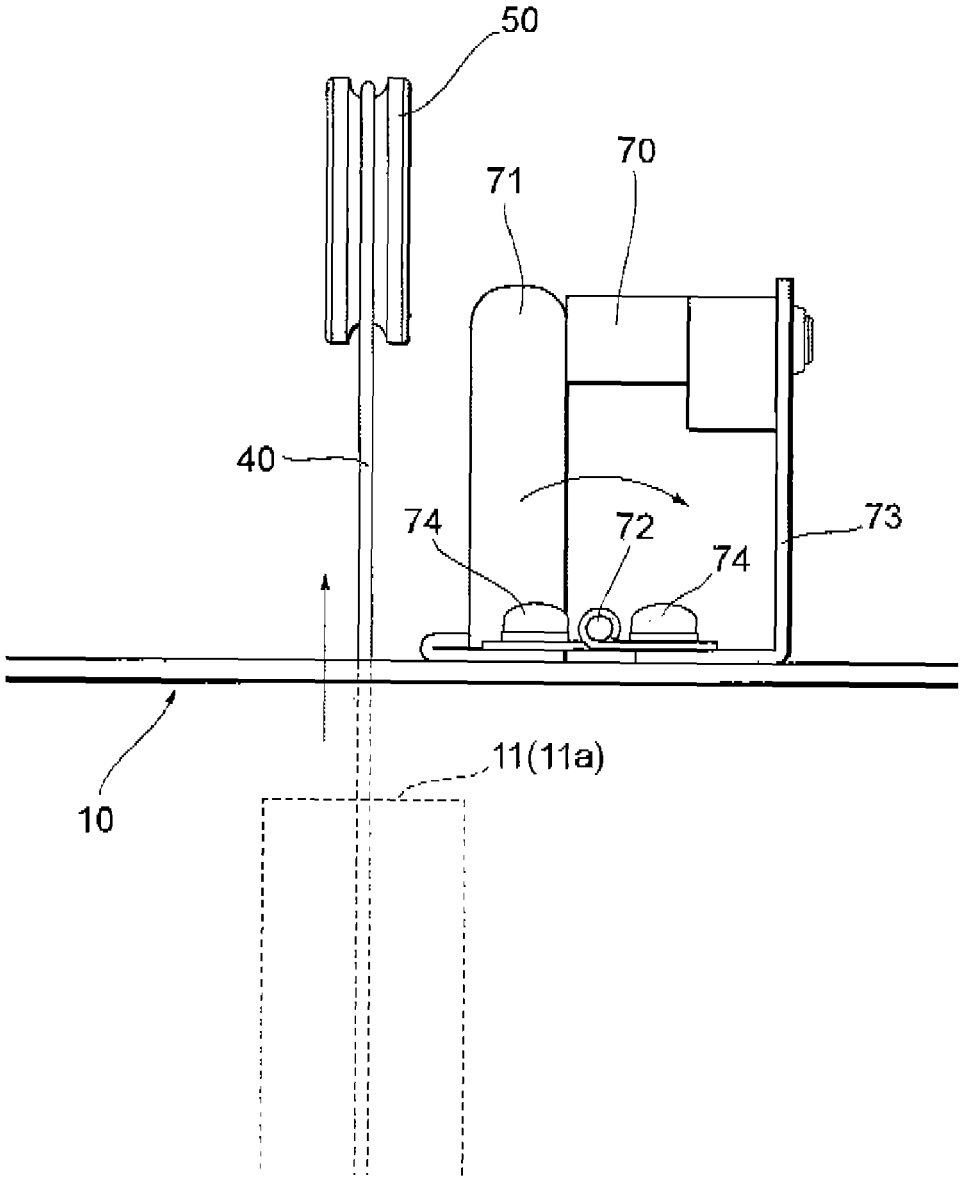
[FIG. 40] It is a diagram showing the state of a topping sensor and the vicinity at the normal time.
Figure 41:
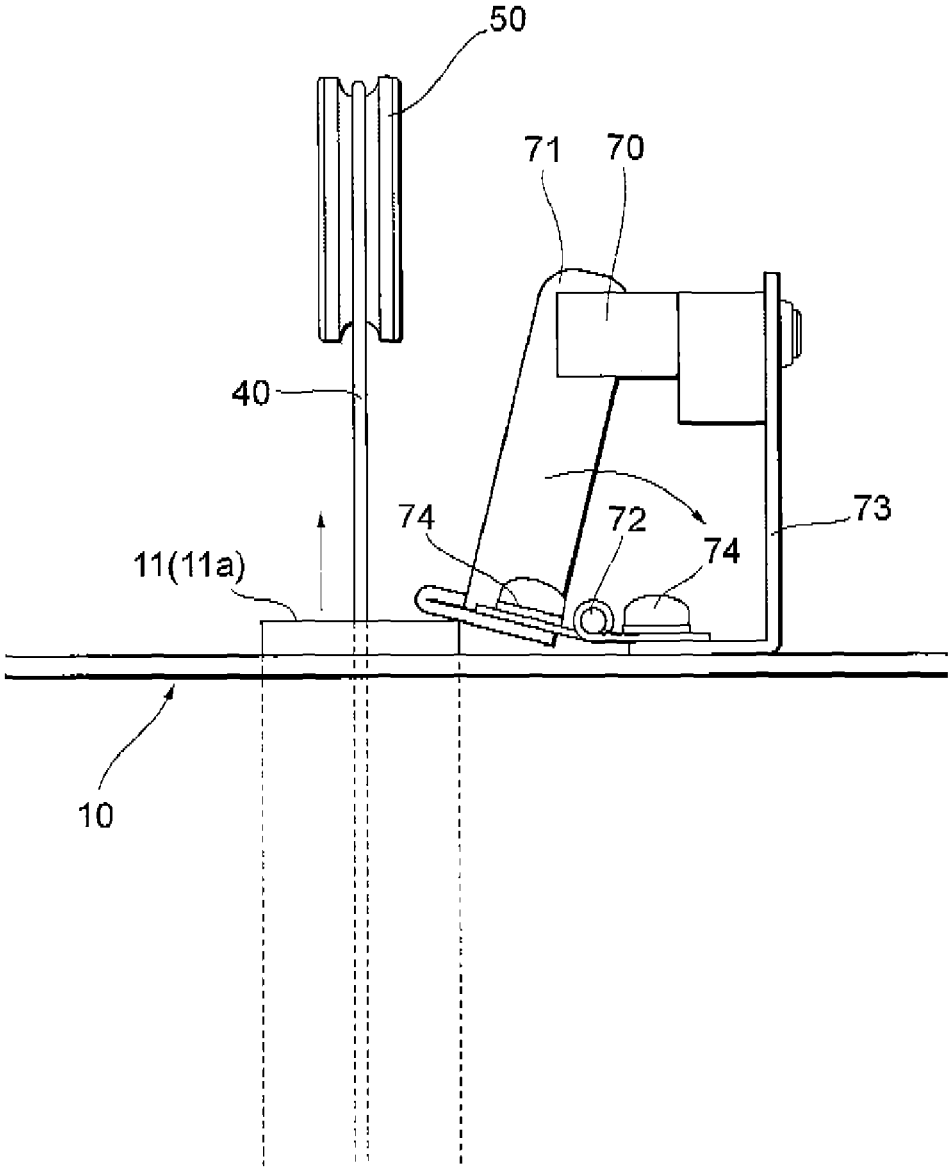
[FIG. 41] It is a diagram showing the state of the topping sensor and the vicinity when the topped state is detected.

A light shielding plate 71 is provided in a position where the upper end of the support member 11 can contact in the prize capturing base 10 (see FIG. 40 and FIG. 41). This light shielding plate 71 is provided to be selectable between a light shielding state where light to the topping sensor 70 is shielded and a retracted state where light is not shielded, and supported by a torsion coil spring 72, for example. At the normal time, since the light shielding plate 71 is biased by the torsion coil spring 72 to be in the retracted state, the topping sensor 70 is not light-shielded and it is off (see FIG. 40). When the light shielding plate 71 is lifted up from the bottom thereof by the upper end of the support member 11, it falls to the topping sensor 70 side to shield light (see FIG. 41). Along with this, the topping sensor 70 is turned on to sends out the travel limit detection signal S2. Note that reference numeral 73 designates a frame for supporting the topping sensor on the prize capturing base 10 and reference numeral 74 designates a screw for attaching the torsion coil spring 72 to this frame 73 or the light shielding plate 71.

On the other hand, the bottoming sensor 80 is a sensor basically for detecting that the prize capturing section 5 comes into contact with any part in the housing 3 such as the floor panel or the frame or any object including the accommodated prize P and hence becomes a stationary state (bottomed state), such as a state where the lowered prize capturing section 5 strikes, for example, against the prize P and rests thereon, or a state where it bumps into the placement surface 3*a* in the prize placement field in the housing 3 or the frame of the prize drop hole (article input port) 17*a*. A swinging member 82 including a light shielding plate 81 and the like is provided near this bottoming sensor 80 (see FIG. 38 and FIG. 39).

The swinging members 82 consists of the light shielding plate 81, a first guide reel 45, a second guide reel 50, a spindle 46, and a swing frame 83. The second guide reel 50 is rotatably supported by the spindle 46 to guide the wire 40 by which the prize capturing section 5 is suspended. The swing frame 83 is rotatably (swingably) attached to this spindle 46. The first guide reel 45 is rotatably supported on one end side of this swing frame 83. The first guide reel 45 stands between the wire reel 44 and the second guide reel 50 to guide the wire 40. The above-mentioned light shielding plate 81 is attached on the other end of the swing frame 83 to rotate (swing) about the spindle 46 by the same amount. The swinging member 82 is biased by a torsion coil spring 75 provided in spindle 46 in the counterclockwise direction in the drawings (direction in which the first guide reel 45 pushes down the wire 40) (see FIG. 36 and FIG. 37).

Such a swinging member 82 behaves as follows, namely: At the normal time, the prize capturing section 5 is suspended by the wire 40 stretched between the wire reel 44 and the second guide reel 50 to push up the guide reel 45 (see FIG. 38). Therefore, the swinging member 82 at the normal time is swinging about the spindle 46 in the clockwise direction in the drawing. At this time, the light shielding plate 81 stands between a light emitting element and a light-receiving element of the bottoming sensor 80 to shut out light, and the bottoming sensor 80 is on-state (see FIG. 38).

Figure 39:
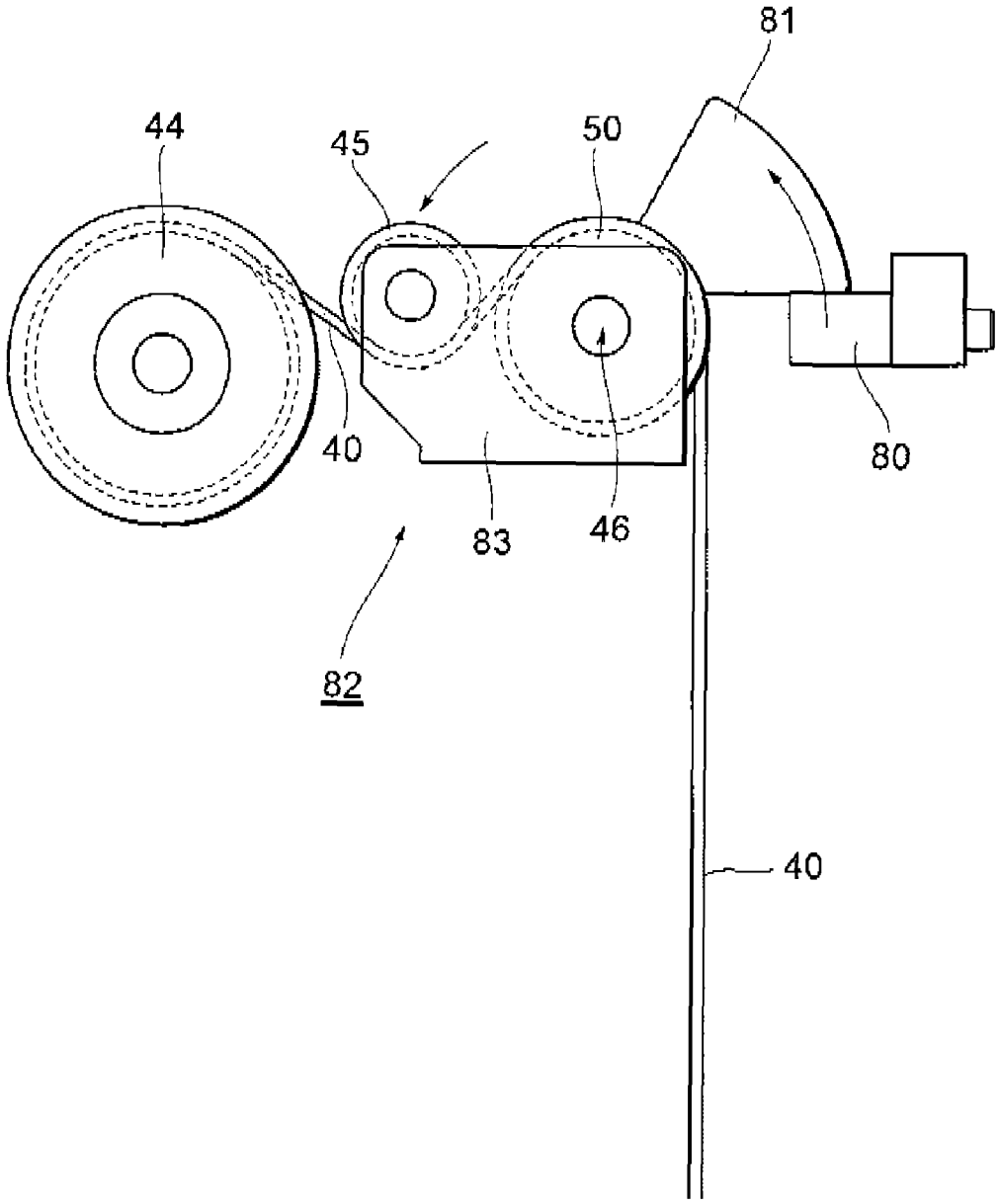
[FIG. 39] It is a diagram showing the state of the bottoming sensor and the vicinity when the bottomed state is detected.

When the prize capturing section 5 is moved downward and bottomed out the tension of the wire 40 is eliminated, so that the swinging member 82 swings in the counterclockwise direction' in which it is biased (see FIG. 39). Along with this movement, the light shielding plate 81 is withdrawn from the bottoming sensor 80, so that the bottoming sensor 80 becomes off-state. Thus, based on the change in the state of the bottoming sensor 80, it can be detected that the prize capturing section 5 is bottomed out.

While the aforementioned embodiments are preferred examples of the present invention, it is to be understood that the present invention is not limited to the embodiments, and various modifications will become possible without departing from the spirit of the invention. For example, the aforementioned embodiments assume such a case that the prizes P are stored in the box housing 3, but this case is just one example of the embodiments of the present invention. The present invention is also applicable to a case where articles other than the prizes P are stored. As an example, the present invention can, of course, be applied to an article capturing game machine in a system for storing articles exchangeable for other prizes separately prepared is a store.

INDUSTRIAL APPLICABILITY

In particular, the present invention is suitably applied to a crane machine type prize capturing game machine 1.

The invention claimed is:

1. An article capturing game machine comprising:

an article housing section for storing a plurality of articles;

an article capturing section for capturing an article in the article housing section;

a lifting device for moving the article capturing section up and down;

a control device for controlling movement of the article capturing section by the lifting device; and a detection device for detecting that the article capturing section being moved downward by the lifting device strikes against any object including the article in the article housing section, wherein the control device performs control for operating the lifting device to continue to move the article capturing section downward even after the control device receives a detection signal from the detection device, and after the continued downward movement, stopping the downward movement of the article capturing section.

2. The article capturing game machine according to claim 1, further comprising:

a moving device for moving the article capturing section horizontally; and a position detection device for detecting a horizontal position to which the article capturing section has been moved by the moving device, wherein the control device performs control for determining, through the position detection device, whether the article capturing section is located in a preset, fixed range in the horizontal direction, and if the article capturing section is located in the fixed range, operating the lifting device to continue to move the article capturing section downward even after the control device receives the detection signal from the detection device, and after the continued downward movement, stopping the downward movement of the article capturing section, or if the article capturing section is not located in the fixed range, the control device performs control for stopping the downward movement of the article capturing section in response to receiving the detection signal from the detection device.

3. The article capturing game machine according to claim 2, further comprising an article input port provided in the article housing section to input an article in the article housing section, wherein the position detection device detects whether the article capturing section is located in a fixed range above the article input port, and the control device performs control for determining, through the position detection device, whether the article capturing section is located in the fixed range above the article input port, and if the article capturing section is located in the fixed range, operating the lifting device to continue to move the article capturing section downward even after the control device receives the detection signal from the detection device, and after the continued downward movement, stopping the downward movement of the article capturing section.

4. The article capturing game machine according to claim 3, further comprising an adjustment device for adjusting, under the control of the control device, time or distance from when the lifting device continues to move the article capturing section downward after the control device receives the detection signal until the downward movement is stopped.

5. The article capturing game machine according to claim 2, further comprising an adjustment device for adjusting, under the control of the control device, time or distance from when the lifting device continues to move the article capturing section downward after the control device receives the detection signal until the downward movement is stopped.

6. The article capturing game machine according to claim 1, further comprising an adjustment device for adjusting, under the control of the control device, time or distance from when the lifting device continues to move the article capturing section downward after the control device receives the detection signal until the downward movement is stopped.

7. An article capturing game machine comprising:

an article housing section for storing a plurality of articles;

an article capturing section for capturing an article in the article housing section;

a lifting device for moving the article capturing section up and down;

a control device for controlling movement of the article capturing section by the lifting device;

a detection device for detecting that the article capturing section being moved downward by the lifting device strikes against any object including the article in the article housing section; and an operation device for allowing a player to control for capturing the article, wherein when receiving an operation signal from the operation device, the control device performs control for operating the lifting device to continue to move the article capturing section downward even after the control device receives a detection signal from the detection device, and after the continued downward movement, stopping the downward movement of the article capturing section.

8. An article capturing game machine comprising:

an article housing section for storing a plurality of articles;

an article capturing section for capturing an article in the article housing section;

a lifting device for moving, up and down, the article capturing section being suspended;

a control device for controlling movement of the article capturing section by the lifting device; and a weight detection device for detecting a weight of the article capturing section suspended by the lifting device, wherein the control device performs control for determining, based on a detection signal from the weight detection device, whether the weight reaches a preset, given weight, operating the lifting device to continue to move the article capturing section downward until the weight reaches the given weight, and when the weight reaches the given weight, stopping the downward movement of the article capturing section.

* * * * *

UNITED STATES PATENT AND TRADEMARK OFFICE

CERTIFICATE OF CORRECTION

PATENT NO. : 7,918,458 B2
APPLICATION NO. : 12/527095
DATED : April 5, 2011
INVENTOR(S) : Fukazawa et al.

It is certified that error appears in the above-identified patent and that said Letters Patent is hereby corrected as shown below:

ON THE TITLE PAGE:

item (73) Assignee:, change "Kabushiki Kaisha Sega, Tokyo (JP)" to --Kabushiki Kaisha Sega d/b/a Sega Corporation, Tokyo (JP)--

Signed and Sealed this
Seventeenth Day of May, 2011

David J. Kappos

David J. Kappos
*Director of the United States Patent and Trademark Office*